US012357077B2

(12) United States Patent
Naftali et al.

(10) Patent No.: US 12,357,077 B2
(45) Date of Patent: Jul. 15, 2025

(54) DRINK BLADDER WITH MAGNETIC CLOSURE DEVICE

(71) Applicant: Fidlock GmbH, Hannover (DE)

(72) Inventors: Philip Naftali, Hod Hasharon (IL); Izik Moalem, Hod Hasharon (IL); Breido Botkus, Hannover (DE); Joachim Fiedler, Hannover (DE); Holger Knorr, Barsinghausen (DE); Timo Severain, Melsungen (DE); Joschan Aderhold, Hannover (DE); Friedemann Richter, Hannover (DE)

(73) Assignee: Fidlock GmbH, Hannover (DE)

( * ) Notice: Subject to any disclaimer, the term of this patent is extended or adjusted under 35 U.S.C. 154(b) by 0 days.

(21) Appl. No.: 18/032,024

(22) PCT Filed: Mar. 3, 2022

(86) PCT No.: PCT/EP2022/055414

§ 371 (c)(1),
(2) Date: Apr. 14, 2023

(87) PCT Pub. No.: WO2022/200013

PCT Pub. Date: Sep. 29, 2022

(65) Prior Publication Data

US 2023/0389680 A1 Dec. 7, 2023

(30) Foreign Application Priority Data

Mar. 23, 2021 (DE) ..... 10 2021 202 822.5

(51) Int. Cl.
*A45F 3/20* (2006.01)

(52) U.S. Cl.
CPC ..... *A45F 3/20* (2013.01)

(58) Field of Classification Search
CPC ..... A45F 3/20
(Continued)

(56) References Cited

U.S. PATENT DOCUMENTS 2,319,292 A 5/1943 Boggs
3,326,399 A * 6/1967 Ausnit ..... A41F 1/002 428/323

(Continued)

FOREIGN PATENT DOCUMENTS

CN 105559301 A 5/2016
DE 20109821 U1 * 9/2001 ..... B65D 33/1658

(Continued)

OTHER PUBLICATIONS

Machine translation of DE20109821U1 (Year: 2001).*

(Continued)

*Primary Examiner* — Jes F Pascua
(74) *Attorney, Agent, or Firm* — The Webb Law Firm

(57) ABSTRACT

Provided is a drinking bladder, including a hollow body for receiving a liquid, which includes a closure device with a closure compound. The closure compound can be adjusted from a release position, in which the first and second closing portions can be properly separated from each other against a magnetic force applied by first and second closure parts to clear an opening on the hollow body, by folding or rolling the first and second closing portions at least once into a closing position. The closure compound disposed in its closing position is secured via a securing mechanism.

20 Claims, 13 Drawing Sheets

(58) Field of Classification Search
USPC ..... 383/68, 89, 91
See application file for complete search history.

(56) References Cited

U.S. PATENT DOCUMENTS

| | | | |
|---|---|---|---|
| 4,420,097 | A | 12/1983 | Motsenbocker |
| 4,815,893 | A | 3/1989 | Feder |
| 5,060,833 | A | 10/1991 | Edison et al. |
| 5,498,364 | A | 3/1996 | Speer et al. |
| 5,545,157 | A | 8/1996 | Van Iten |
| 5,682,653 | A | 11/1997 | Berglof et al. |
| 5,781,561 | A | 7/1998 | Machida et al. |
| 5,941,640 | A | 8/1999 | Thatcher |
| 7,636,989 | B2 | 12/2009 | Plourde et al. |
| 8,479,685 | B2 | 7/2013 | Sprung |
| 9,963,913 | B2 | 5/2018 | Howell et al. |
| 9,966,174 | B2 | 5/2018 | Naftali et al. |
| 11,027,889 | B1 | 6/2021 | Western et al. |
| 11,156,242 | B2 | 10/2021 | Meyran |
| 11,174,090 | B2 | 11/2021 | Rogers et al. |
| 2002/0094140 | A1 | 7/2002 | Gill |
| 2003/0077007 | A1 | 4/2003 | Turvey et al. |
| 2004/0010891 | A1 | 1/2004 | Byers, Jr. |
| 2004/0183313 | A1 | 9/2004 | Sherman et al. |
| 2005/0276523 | A1 | 12/2005 | Munch-Fals |
| 2006/0006969 | A1 | 1/2006 | Cassar |
| 2006/0068662 | A1 | 3/2006 | Hanrahan et al. |
| 2006/0222845 | A1 | 10/2006 | Deng et al. |
| 2009/0017086 | A1 | 1/2009 | Racquet |
| 2009/0100651 | A1 | 4/2009 | Naftalin et al. |
| 2010/0071415 | A1 | 3/2010 | Voss et al. |
| 2010/0122393 | A1 | 5/2010 | Light et al. |
| 2010/0187139 | A1 | 7/2010 | Schmiedinghoefer |
| 2011/0188785 | A1 | 8/2011 | Turvey et al. |
| 2012/0305437 | A1 | 12/2012 | Shah et al. |
| 2013/0243354 | A1 | 9/2013 | Lytle |
| 2014/0029875 | A1 | 1/2014 | Mallett et al. |
| 2015/0052617 | A1 | 2/2015 | Zar |
| 2015/0216276 | A1 | 8/2015 | Stratton |
| 2017/0095048 | A1 | 4/2017 | Kohn et al. |
| 2017/0225842 | A1 | 8/2017 | Yeh |
| 2018/0109662 | A1 | 4/2018 | Scheer |
| 2018/0140026 | A1 | 5/2018 | Nijmeh |
| 2018/0215633 | A1 | 8/2018 | Laufer et al. |
| 2019/0152840 | A1 | 5/2019 | Ferner et al. |
| 2020/0055659 | A1 | 2/2020 | Hochberg et al. |
| 2020/0075209 | A1 | 3/2020 | Naftali et al. |
| 2020/0113317 | A1 | 4/2020 | Okumi et al. |

FOREIGN PATENT DOCUMENTS

| | | | | |
|---|---|---|---|---|
| DE | 102006026033 | A1 | | 12/2007 |
| DE | 202009001015 | U1 | | 5/2009 |
| DE | 102010060775 | A1 | | 5/2012 |
| DE | 102015112400 | A1 | | 2/2017 |
| DE | 102016003868 | A1 | | 10/2017 |
| DE | 102020206048 | A1 | | 11/2021 |
| EP | 2571391 | B1 | | 2/2019 |
| GB | 2442542 | A | | 4/2008 |
| GB | 2522655 | A | | 8/2015 |
| GB | 2527063 | A | | 12/2015 |
| IL | 205846 | A | | 8/2016 |
| JP | S4526601 | Y1 | | 10/1970 |
| JP | S4846010 | U | | 6/1973 |
| JP | S5037627 | U | | 4/1975 |
| JP | S61146982 | A | | 7/1986 |
| JP | S6294552 | A | | 5/1987 |
| JP | H642691 | U | | 6/1994 |
| JP | H655654 | U | | 8/1994 |
| JP | H0655654 | U | * | 8/1994 |
| JP | 3030902 | U | | 11/1996 |
| JP | 2000238802 | A | | 9/2000 |
| JP | 2004083063 | A | | 3/2004 |
| JP | 3170193 | U | | 9/2011 |
| JP | 201619570 | A | | 2/2016 |
| WO | 2007088392 | A1 | | 8/2007 |
| WO | 2014123367 | A1 | | 8/2014 |
| WO | 2016151433 | A1 | | 9/2016 |
| WO | 2020028397 | A1 | | 2/2020 |
| WO | 2020036791 | A1 | | 2/2020 |
| WO | 2021161299 | A1 | | 8/2021 |

OTHER PUBLICATIONS

Machine translation of JPH0655654U (Year: 1994).*

Garza-Cervantes et al., "Synergistic Antimicrobial Effects of Silver/Transition-metal Combinatorial Treatments", Scientific Reports, 2017, pp. 1-16, vol. 7:903.

* cited by examiner

DRINK BLADDER WITH MAGNETIC CLOSURE DEVICE

CROSS-REFERENCE TO RELATED APPLICATIONS

This application is the United States national phase of International Patent Application No. PCT/EP2022/055414, filed Mar. 3, 2022, and claims priority to German Patent Application Number 10 2021 202 822.5, filed Mar. 23, 2021, the disclosures of which are hereby incorporated by reference in their entireties.

BACKGROUND OF THE INVENTION

Field of the Invention

The proposed solution relates to a drinking bladder comprising a closure device for closing an opening that is formed on the drinking bladder between a first closing portion and a second closing portion.

Description of Related Art

Via the opening closed by means of the closure device, a cavity in a hollow body of the drinking bladder is closed. Different solutions, for instance with a screw cap, are known from practice, via which a drinking bladder is effectively secured against inadvertent opening on the part of a user. Previously used closure devices on drinking bladders, however, regularly are not perceived as particularly innovative or valuable and also are not always comfortable in terms of handling for a user. Therefore, drinking bladders involve a further need for improvement in this respect. In particular, it should be taken into account that for instance due to an increased internal pressure in a cavity of the drinking bladder closed by the closure device quite significant (increased) forces may be applied on closure parts of a closure device.

SUMMARY OF THE INVENTION

In this respect, a drinking bladder as described herein represents an improvement over the solutions known from the prior art.

A proposed drinking bladder comprises a hollow body for receiving a liquid and a closure device. The hollow body has at least one flexible wall and at least one port for connection to a drinking tube. Via an opening that is formed between a first closing portion and a second closing portion and can be closed by the closure device, liquid can be filled into the hollow body. The closure device includes a first closure part on the first closing portion and a second closure part on the second closing portion, wherein

- the first closure part includes a first strip body longitudinally extended along a transverse direction,
- the second closure part includes a second strip body longitudinally extended along the transverse direction,
- the first closure part and the second closure part cooperate in a magnetically attracting manner in such a way that in a closed position of the closure device the first closing portion and the second closing portion rest against each other and form a closure compound (2V) with the first and second closure parts, and
- the closure compound can be adjusted from a release position, in which the first and second closing portions can be properly separated from each other against a magnetic force applied by the first and second closure parts to clear the opening, by folding or rolling the first and second closing portions at least once into a closing position.

The closure device furthermore comprises a securing mechanism via which the closure compound disposed in its closing position is secured.

In one design variant, the closure device additionally can comprise a third closure part on a first closing portion, with which the closure compound in its closing position cooperates in a magnetically attracting manner. Via the additional securing mechanism, the closing position can additionally be secured mechanically so that the securing mechanism prevents an inadvertent removal of the closure compound from the third closure part. In principle, however, the proposed solution also is advantageous without such a third closure part cooperating with the closure compound in a magnetically attracting manner.

One design variant of a proposed drinking bladder comprises a closure device in which the closing portions can be adjusted into the closing position by folding or rolling at least once, and the securing mechanism secures the closure compound against (inadvertent) removal from its closing position taken in this way due to an increased internal pressure in the hollow body that is closed at the opening by the closure device. A proposed closure device (in particular independently of a third closure part magnetically cooperating with the closure compound) was found to be advantageous in order to secure a closing position taken by folding or rolling at least once against inadvertent opening, when due to an increased internal pressure shear and/or lifting forces act on the first and second closure parts on a hollow body of a drinking bladder that is closed by the closure device. Via an additional securing mechanism, it here is possible to effectively counteract in particular shear forces that act in a middle portion of the strip bodies of the first and second closure parts in a direction perpendicular to a direction of longitudinal extension of the strip bodies, and/or lifting forces that act on the closure compound at the longitudinal ends and by action of which the closure parts strive to move away from each other.

In principle, in the closing position the securing mechanism accordingly can be adapted to

- counteract a lifting force acting on the first and second strip bodies at the longitudinal ends and resulting from the increased internal pressure, by action of which mutually opposite longitudinal ends of the first and second strip bodies strive to move away from each other, and/or
- counteract a shear force resulting from the increased internal pressure, which acts in a middle area of the first and second strip bodies on the closure device in a plane extending parallel to the first and second closing portions.

Accordingly, the securing mechanism in particular can be adapted to counteract a shear force that acts between the first and second closure parts, between the closure compound and a third closure part, or between the closure compound and a wall opposite to which the closure compound is disposed in the closing position.

The proposed solution proceeds from the underlying idea to additionally mechanically secure the closure compound in its closing position with the closing portions resting against each other in the closed position against a displacement into the release position, in any case as long as no release force applied by a user acts on the closure compound along a particular, specified direction of action. In this way, in particular an inadvertent opening of the closure compound can be prevented. Thus, the additional securing mechanism can be actuated manually and hence can be released in order to be able to again adjust the closure compound into the release position. Without a deliberate release of the securing mechanism on the part of the user, the closure compound however remains blocked against an adjustment into the release position. Thus, via the first and second closure parts with their strip bodies a (possibly already sealing) termination is provided at the closing portions, which is mechanically secured against inadvertent opening via the securing mechanism. Removal from the closing position, against which a mechanical securement is provided via the securing mechanism, thus not only is understood to be an inadvertent removal by a user actively acting on the closure device, but in particular an (at least partial) removal from the closing position, which results from a load acting on the closure device, which is not applied by a user.

In the closing position, the first and second closing portions can be present in folded or rolled form, in particular in that the first and second closing portions and hence walls including the closing portions are bent over by 180° at least once, as seen along a path of extension in a cross-section perpendicular to the transverse direction.

The strip bodies are arranged on the closing portions and thus act on the closing portions, wherein the closure parts cooperate in a magnetically attracting manner and the closing portions thus are magnetically held in contact with each other when the first and second closure parts are in their closed position.

To provide magnetic interaction, the first strip body and/or the second strip body can each be formed of a magnetic material, for example in that the strip bodies are formed of a plastic material, in particular a polymer material, or a silicone material to which a magnetic material in the form of magnetic particles is admixed. Alternatively, the strip bodies can each receive a magnet arrangement of discrete magnetic elements so that the strip bodies cooperate in a magnetically attracting manner by interaction of the magnet arrangements. It is conceivable that each closure part acts as a permanent magnet, for example in that the strip bodies are formed with permanent magnetic particles and thus are made of a permanent magnetic material, or in that the magnet arrangements of the closure parts are each formed of an arrangement of permanent magnets. Alternatively, however, it is also possible that one closure part acts as a permanent magnet and the other closure part acts as a ferromagnetic armature, for example in that the ferromagnetically acting closure part has a strip body of a ferromagnetic material (for example of a plastic material to which ferromagnetic particles are admixed) or includes discrete ferromagnetic elements.

When a closure part includes a magnet arrangement of discrete magnetic elements, the discrete magnetic elements for example can be lined up linearly along the transverse direction, wherein the discrete magnetic elements for example can be regularly spaced apart from each other along the transverse direction. It is also conceivable and possible, however, to arrange the discrete magnetic elements in rows and columns with reference to a two-dimensional matrix.

In principle, a third closure part also can include a third strip body extended along the transverse direction. For example, the third closure part is arranged on an offset portion of a first wall, which is different from the first closing portion. In the closed position, the third closure part for example can cooperate with the first closure part in a magnetically attracting manner in order to hold the closure compound in the closing position.

The third closure part can be arranged spatially offset from the first closing portion perpendicularly to the transverse direction. In such a design variant, the third closure part thus is designed with its third strip body extending parallel to the first strip body of the first closure part, but offset transversely to the first closure part.

In the closed position, the third strip body and the first strip body for example can be in flat opposition to each other with surfaces facing each other. The closure parts cooperate in a magnetically attracting manner so that the first closure part is held in a defined positional relation to the third closure part.

In one design variant, the first strip body and/or the second strip body and/or a third strip body of a third closure part are of elastic design. A strip body for example can have an increased rigidity with respect to walls of a hollow body at which the closure device is inserted, but at the same time is so elastic that it can be bent, in particular about a vertical direction perpendicular to the transverse direction.

Via the securing mechanism, an additional connection between the closure compound and a wall connected to the first closing portion and/or between the closure compound and the third closure part can be provided when the closure compound is disposed in the closing position. A connection between the closure compound and the third closure part for example includes the fact that in the closing position a connection between the first closure part and the third closure part or between the second closure part and the third closure part is provided via the securing mechanism. The additional connection provided via the securing mechanism can be of the positive type and be provided for absorbing shear forces acting on the closure device.

For example, the securing mechanism includes at least one securing part which via a positive connection secures the closure compound against removal from the third closure part. The positive connection in principle can exist already in the closing position of the closure compound. However, this also includes a design variant in which a positive connection for securing the closure compound against removal from the third closure part only exists when a certain load acts on the closure device.

In a development, the securing mechanism includes at least two securing parts which in the closing position of the closure compound positively cooperate with each other in order to secure the closure compound against removal from the third closure part. These at least two securing parts likewise can positively get into engagement with each other already when the closure compound reaches the closing position or, alternatively, can at least be brought into a relative position to each other, in which under a load acting on the closure device the positive engagement of the two securing parts into each other is realized automatically.

In a development based thereon, a first securing part and a second securing part are provided, wherein the first securing part is adapted to engage behind the second securing part in order to secure the closure compound against removal from the third closure part. By correspondingly engaging behind and hence by an undercut formed on the securing mechanism, an effective positive securement of the two securing parts to each other on the one hand can be ensured. On the other hand, it can thereby also be achieved comparatively easily that the securing parts can again be brought out of engagement only by a targeted release movement. An inadvertent separation of the securing parts, in particular in a loaded state of the closure device, thus is excluded.

In principle, a securing part of the securing mechanism can also be formed on one of the closure parts. Alternatively or additionally, a securing part can be formed by a component of the closure device separate from a closure part.

In one design variant, the closure device comprises at least one magnetic element by action of which at least one securing part of the securing mechanism is positioned in a securing position in which the at least one securing part can block the closure compound against removal from the third closure part via a positive connection. A corresponding magnetic element here can also be formed by magnetic material in the form of magnetic particles. Alternatively, a magnetic element can comprise a permanent magnet that is arranged at a corresponding point on the closure device.

In a securing position, in which a securing part of the securing mechanism is positioned by action of at least one magnetic element, the securing part can already be in positive engagement in order to secure the closure compound against an adjustment into the release position. It can, however, also be provided that the securing part in its securing position still is disposed in an intermediate position from which the securing part is displaced into an engagement position only by action of an additional load on the closure device, in which engagement position the blocking positive engagement then exists.

One design variant furthermore provides that by action of the at least one magnetic element the at least one securing part also is adjusted into the securing position already on transfer of the closure compound into its closing position. Thus, the at least one magnetic element ensures that the at least one securing part is disposed in its securing position when the closure compound reaches the closing position.

In an alternative design variant, the at least one securing part can be adjusted into its closing position only after transfer of the closure compound and hence subsequently in the direction of the securing position. This subsequent adjustment can be supported by the at least one magnetic element—at least in a last piece of an adjustment path before reaching the securing position—, in order to support the taking of a specified position by the at least one securing part in the securing position by magnetic attraction.

In principle, an additional positive connection can be provided between the closure compound and a wall to which the first closing portion is connected, in order to secure a taken engagement position. For example, one design variant therefor provides at least one form-fit element on the side of the closure compound, e.g. in the form of a latching nose or a latching web, which engages into a wall-side latching opening when the securing part is disposed in the engagement position.

In one design variant, an additional securing element is provided on the closure compound, to which at least one securing part of the securing mechanism is fixed at a distance to the first and second closure parts. The securing element for example has a flexible or rigid carrier body to which the at least one securing part is fixed. For example, the securing part is provided offset from the first and second closure parts in a spatial direction that extends transversely to the direction of extension of the strip bodies of the first and second closure parts. Via the securing part provided on the additional securing element, a mechanical arrestment of the closure compound in the closing position can thus be provided at a distance to the first and second closure parts and possibly also at a distance to the third closure part. Referring to a variant already mentioned above, this for example includes the fact that the securing part provided on the additional securing element forms a first securing part, which in the closing position of the closure compound is positively connected to a second securing part that is provided on a wall connected to the first closing portion and in particular is fixed thereto. The first and second securing parts in particular can form part of a magnetic closure via which the closure compound in its closing position is additionally secured against an adjustment into the release position.

In one design variant, the securing mechanism includes at least one securing part which after the transfer of the closure compound into its closing position by pivoting about at least one joint axis can be adjusted into a securing position securing the closure compound. In the securing position, the at least one securing part consequently secures the closure compound disposed in its closing position against removal from the third closure part. Pivoting of the securing part about its joint axis into its securing position here can be provided after the closure compound has been adjusted into the closing position. In this design variant, the at least one securing part then for example subsequently is specifically pivoted into its securing position by a user in order to additionally secure the closure compound.

The joint axis for example can be defined by a joint via which the at least one securing part is articulated to the closure compound, to a third closure part of the closure device, or to a wall connected to the first or second closing portion. In the latter case, the securing part thus can be articulated to a front, first or rear, second wall along a viewing direction (extending perpendicularly to the longitudinal extension of the first and second strip bodies) onto the closure compound disposed in its closing position.

For example, the joint axis is defined by a film hinge or a film. Via a film hinge or a film, a pivotable securing part can be provided on the closure device at comparatively low cost. For example, the film defining the joint axis can be a portion of a wall of the drinking bladder, to which one of the closing portions is connected.

To keep the closure device as compact as possible, one design variant provides that via the film hinge the at least one securing part is connected to the third closure part. Via the film hinge, the at least one securing part then consequently is articulated to the third closure part and consequently need not be provided on a separate component.

Via the at least one securing part disposed in its securing position, a connection absorbing form-fitting and hence in particular shear forces and/or lifting forces in one design variant is provided between the closure compound disposed in the closing position and the third closure part. Via the film hinge, the securing part for example can also be pivoted relative to a third strip body of the third closure part into its securing position and can then be positively connected to the closure compound, after the closure compound has taken the closing position. Via the film hinge, the securing part can be provided at a longitudinal end of the third strip body. For example, the securing part is of tab-shaped, in particular strip-shaped design.

For a positive connection via the securing part in the securing position pivoted about the joint axis, at least one receptacle can be provided on the at least one securing part, into which a further securing part of the securing mechanism positively engages in the securing position. For example, an opening therefor is provided on the securing part, into which a protruding pin or web of the further securing part engages in the securing position. Alternatively or additionally, a form-fit element can be provided in the at least one securing part, which in the securing position engages into a receptacle of a further securing part of the securing mechanism. A corresponding form-fit element then can be formed by a pin or web here as well, which is inserted into a corresponding receptacle of a further securing part. A further securing part as mentioned above can be formed in particular on a closure part of the closure compound, i.e. for example on the first closure part.

Alternatively or additionally, the securing mechanism can include at least one securing part for the targeted mechanical securement of ends of the closure compound present on the long side (with respect to a direction of longitudinal extension of the strip bodies and hence to the transverse direction) on a wall or on a third closure part. Such securement on the side of the longitudinal ends above all counteracts lifting off vertically, possibly in addition counteracts shearing. A securing part to be used for this purpose for example in particular includes an articulated securing part as already mentioned above. However, this also refers to an alternative design variant in which for example a securing part is formed with a Velcro tape, an O-ring or a sleeve put over a longitudinal end.

As already mentioned above, the closure compound with the first and second closure parts disposed in the closed position can be transferred from the release position into the closing position by pivoting the closure compound about a pivot axis parallel to a first spatial direction (e.g. with respect to a Cartesian coordinate system of the x-direction). The closure compound here consequently is folded about the pivot axis parallel to the first spatial direction, for example by about 180°. A (resultant) magnetic force for holding the closure compound in its closing position with respect to the third closure part then acts along a spatial axis that is parallel to a second spatial direction (y) extending perpendicularly to the first spatial direction. Via the securing mechanism in such a variant, the closure compound is secured against removal from the third closure part due to shear force, i.e. against removal due to a shear force pointing in a third spatial direction (−z), which is both perpendicular to the first spatial direction (x) and perpendicular to the second spatial direction (y). Consequently, when a shear force pointing in the third spatial direction acts on the closure compound, the closure compound is secured via the securing mechanism against a displacement in this spatial direction and hence against a displacement into the release position.

For example, the closure compound can be folded from the release position into the closing position, in which the securing mechanism then secures the closure compound against a displacement relative to the third closure part beyond a permitted degree along the third spatial direction, and hence also against being folded back. This third spatial direction is just opposite to a directional component along which the closure compound is folded into the closing position. The securing mechanism thereby can also prevent lifting or shearing of the closure compound off from the third closure part as a result of a load applied onto the closure device, for instance a load resulting from an increased internal pressure in a cavity closed by the closure device.

One design variant provides that a securing part, which blocks the closure compound against an adjustment along the third spatial direction, initially is disposed in an intermediate position when the closure compound reaches the closing position and only then can be displaced into an engagement position. It can be provided here that due to magnetic attraction the securing part of the securing mechanism (merely) is positioned in the intermediate position when the closure compound is transferred into its closing position.

In one variant, again alternatively or additionally, the displacement into the engagement position, in which for example the one securing part engages behind another securing part of the securing mechanism, can be supported by at least one (additional) magnetic element. There can be provided at least one magnetic element, by action of which the at least one securing element is adjusted from the intermediate position into the engagement position. When the closure compound has taken its closing position and hence the securing part is in the intermediate position, the further adjustment of the securing part into the engagement position consequently is supported by action of a magnetic force.

The magnetically supported adjustment from the intermediate position into the engagement position also can include the fact that via a magnet arrangement of the securing mechanism a bistable state is specified for the position of the securing part, when the closure compound is in its closing position. The securing part then initially is held in the intermediate position via the magnet arrangement. However, when a load via which the closure compound would be displaced in the direction of the release position is acting on the closure device, a related minor displacing movement of the securing part leads to a change in magnetic elements having an attracting effect on each other, and as a result to a magnetically supported displacement of the securing part into the engagement position. This in particular includes the fact that the securing mechanism is adapted to permit a minor displacing movement of the securing part in the direction of action of the shear force by action of a shear force acting on the closure compound, which then however leads to the magnetically supported displacement of the securing part into the engagement position.

Independent of whether the securing part is displaced from the intermediate position into the engagement position with magnetic support, one design variant can provide that the at least one securing part can be displaced from the intermediate position into the engagement position by action of an increased internal pressure in a cavity accessible via the opening. The securing mechanism consequently is con-FIG.d here in such a way that the securing part is automatically displaced into the engagement position when an increased internal pressure, i.e. a pressure exceeding a threshold value, is acting in the cavity. After filling liquid into the cavity of the drinking bladder, in particular during transport or under a load, an internal pressure can increase to such an extent that the securing part on the securing mechanism of the closure device automatically is displaced from the intermediate position into the engagement position. In such a design variant of the proposed closure device, a closing position of the closure compound consequently is automatically, i.e. without the user acting on the securing mechanism, additionally mechanically secured against an adjustment into the release position. After the elimination of the load on the drinking bladder, a return of the securing part into the intermediate position can also be effected automatically, which in turn facilitates the release of the securing mechanism and hence the opening of the closure device. For a user, the mechanical securement of the closing position additionally provided by the securing mechanism thus is without any disturbing influence on the opening of the closure device.

In one design variant, the first strip body of the first closure part for example is enclosed between an inner layer and an outer layer of a first wall that borders a cavity of the hollow body to be closed by the closure device. Additionally or alternatively, the second strip body of the second closure part can be enclosed between an inner layer and an outer layer of a second wall of the hollow body. The respective strip body, which can be designed as a massive strip-shaped tape, thus is disposed in an intermediate layer between the inner layer and the outer layer and thus is enclosed between the layers and hence inwardly covered by the inner layer and outwardly covered by the outer layer.

In one design variant, the first closing portion is formed by the inner layer of the first wall and the second closing portion is formed by the inner layer of the second wall. The closing portion of the respective wall thus is integrally molded to the inner layer of the respective wall. In the closed position, the closing portions flatly rest against each other and produce a sealing termination so that the hollow body is sealingly closed towards the outside, in particular so fluid-tightly that no moisture can get into the interior of the hollow body.

In one design variant, the first wall and/or the second wall are flexible. In particular, both the first wall and the second wall can be flexible and pliable so that the hollow body can be deformed in a flexible, easily moldable way and thus can adapt in its shape to receive a liquid. Due to the walls, the hollow body thus is designed in the form of a bag.

In principle, first and second walls to which the first and second closing portions of a proposed closure device are connected can be part of a continuous wall element. Thus, the first and second walls in particular can be formed in one piece. For example, first and second walls facing each other in a cross-sectional view can be formed by a single, one-piece wall element in the form of a blow-molded part.

BRIEF DESCRIPTION OF THE DRAWINGS

The attached FIGS. by way of example illustrate possible design variants of the proposed solution.

DESCRIPTION OF THE INVENTION

Figure 1:
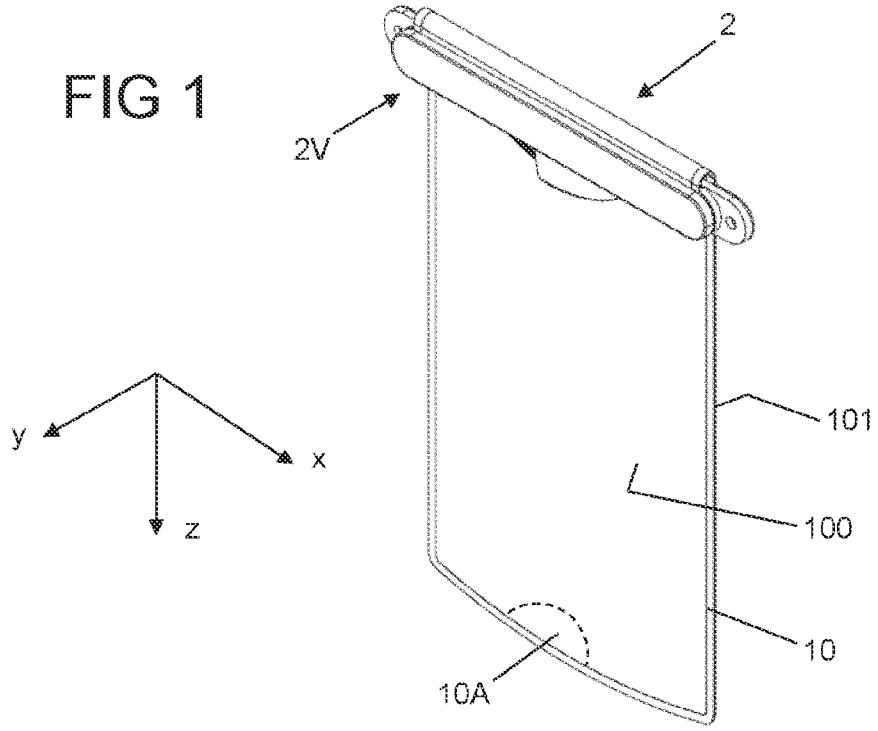
FIG. 1 shows a view of a drinking bladder comprising a hollow body and a closure device according to an exemplary embodiment.
Figure 2:
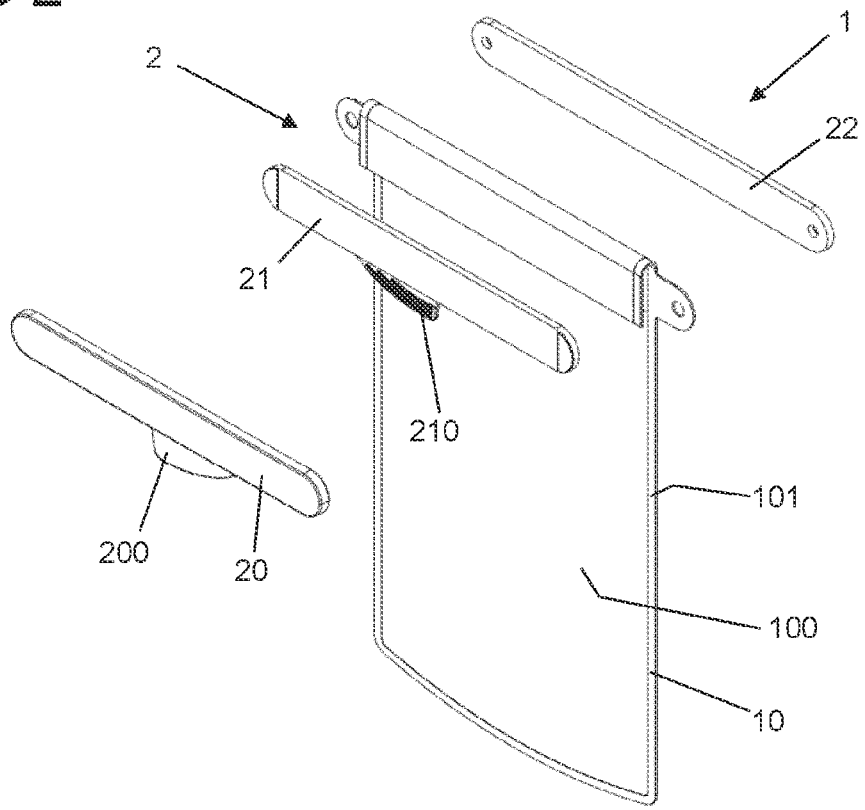
FIG. 2 shows an exploded view of the arrangement of FIG. 1.

FIGS. 1 to 3A-3C show views of a first exemplary embodiment of a drinking bladder 1, which includes a hollow body 10 that is bordered by walls 100, 101 and is designed to hold a liquid in reserve, which can flow off via an outlet 10A provided on the hollow body 10, e.g. into a drinking tube connected thereto.

The walls 100, 101 are connected to each other for example by welding on parallel lateral edges spaced apart from each other along a transverse direction x and on a lower edge along a vertical direction z and are to be closed by a closure device 2 in the region of an upper end so that an inner volume of the hollow body 10 or a cavity defined therewith is sealingly closed in a closed position of the drinking bladder 1. As can be taken from the sectional view of FIG. 3C, each wall 100, 101 is formed by two layers 106, 107, of which an inner layer 106 points towards the inner volume of the hollow body 10 and an outer layer 107 points towards the outside.

The walls 100, 101 are of flexible design so that the hollow body 10 is flexibly deformable in order to be able to expand on receipt of a liquid in the hollow body 10.

The closure device 2 includes three closure parts 20, 21, 22. Of these closure parts 20, 21, 22 a first closure part 21 is arranged on a closing portion 104 of the first wall 100, while a second closure part 20 is arranged on a closing portion 105 of the second wall 101 in such a way that the closure parts 20, 21 extend along the vertical direction z at the same height on the respectively associated wall 100, 101. The closure parts 20, 21 cooperate in a magnetically attracting manner so that in the closed position of the closure device 2 the closing portions 104, 105, which are each formed by the inner layer 106 of the associated wall 100, 101, flatly and thus sealingly rest against each other and form a closure compound 2V.

Figure 3A:
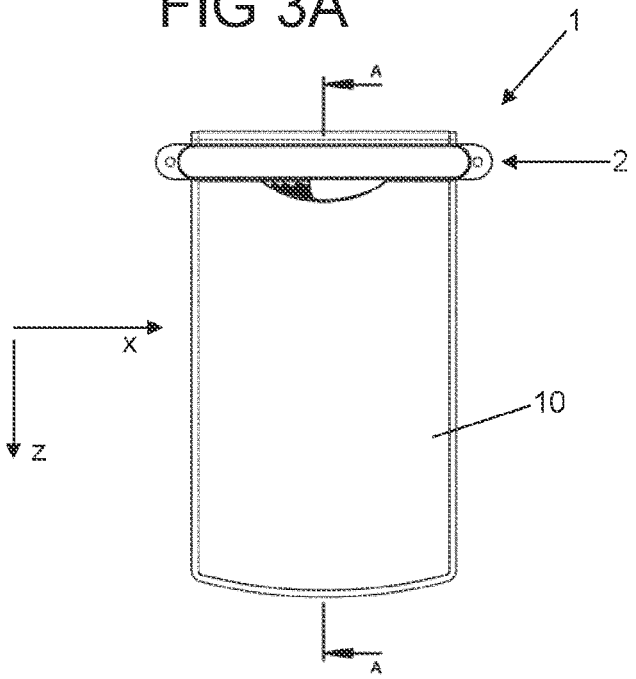
FIG. 3A shows a frontal view of the drinking bladder.
Figure 3B:
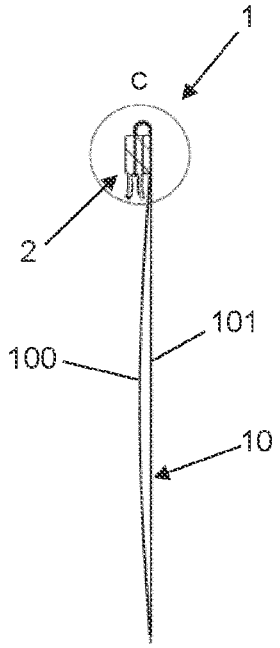
FIG. 3B shows a sectional view along line A-A of FIG. 3A.
Figure 3C:
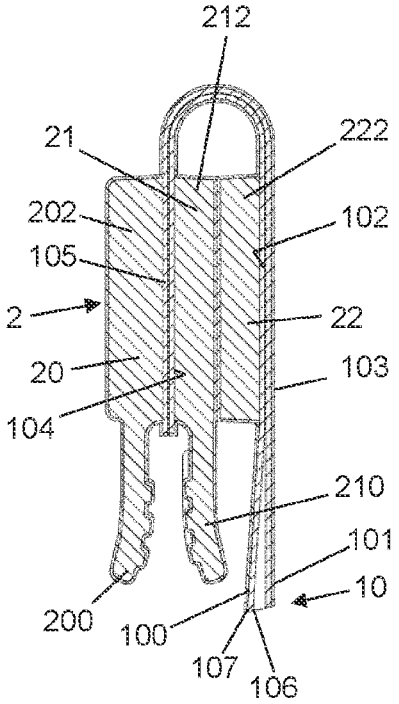
FIG. 3C shows an enlarged view in section B of FIG. 3B.
Figure 4:
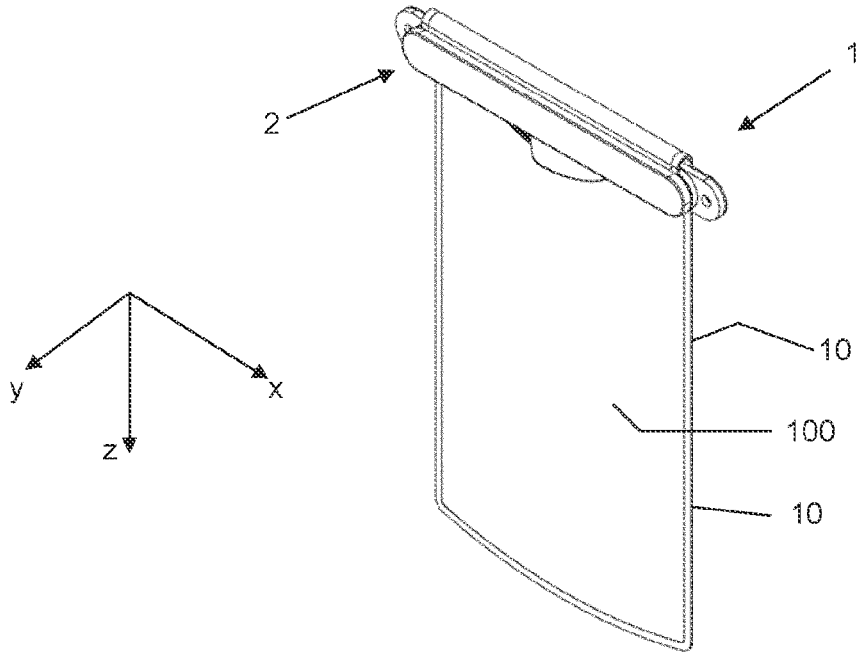
FIG. 4 shows a view of a drinking bladder comprising a hollow body and a closure device according to another exemplary embodiment.
Figure 5:
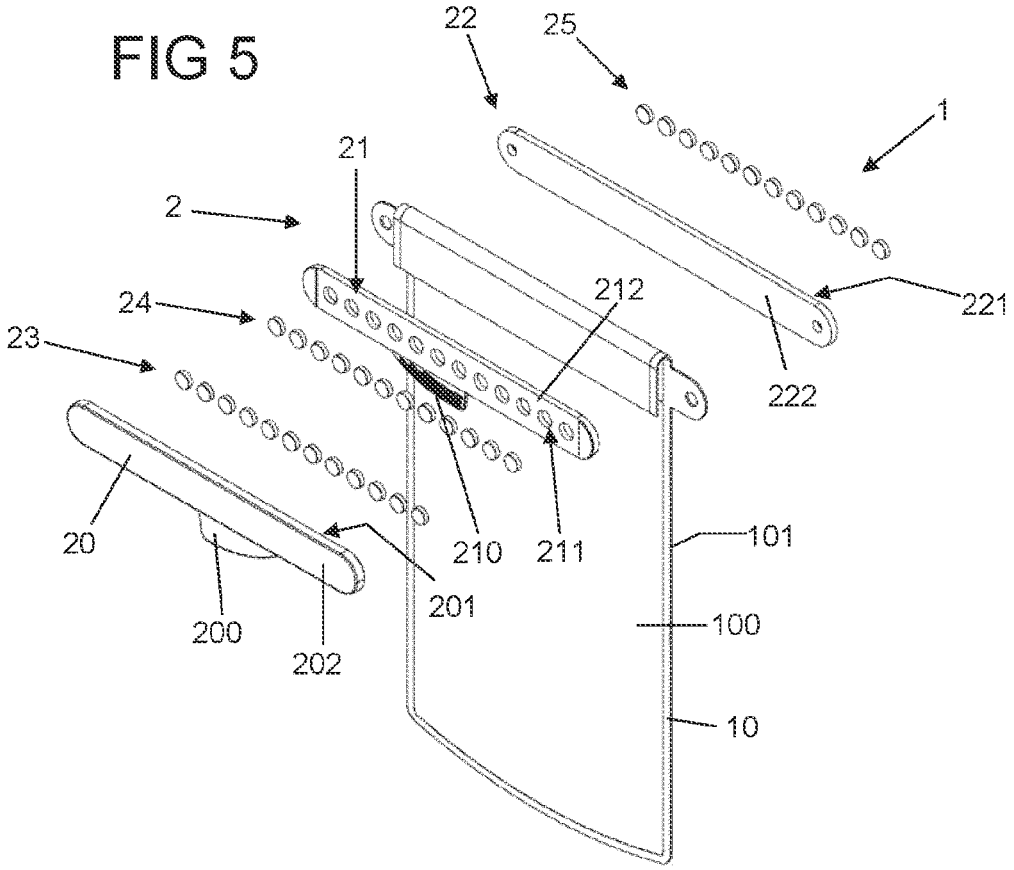
FIG. 5 shows an exploded view of the arrangement of FIG. 4.
Figure 6A:
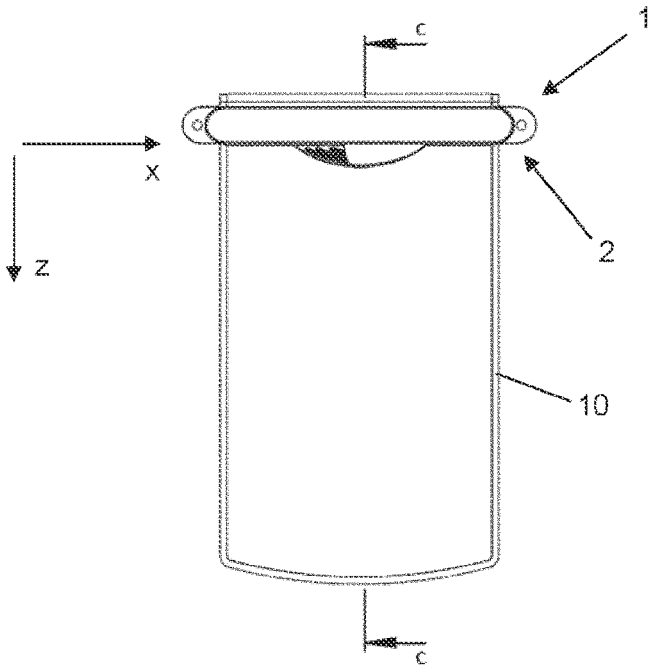
FIG. 6A shows a frontal view of the drinking bladder.
Figure 6B:
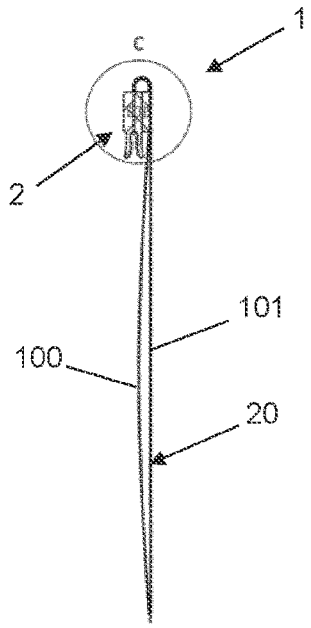
FIG. 6B shows a sectional view along line C-C of FIG. 6A.
Figure 6C:
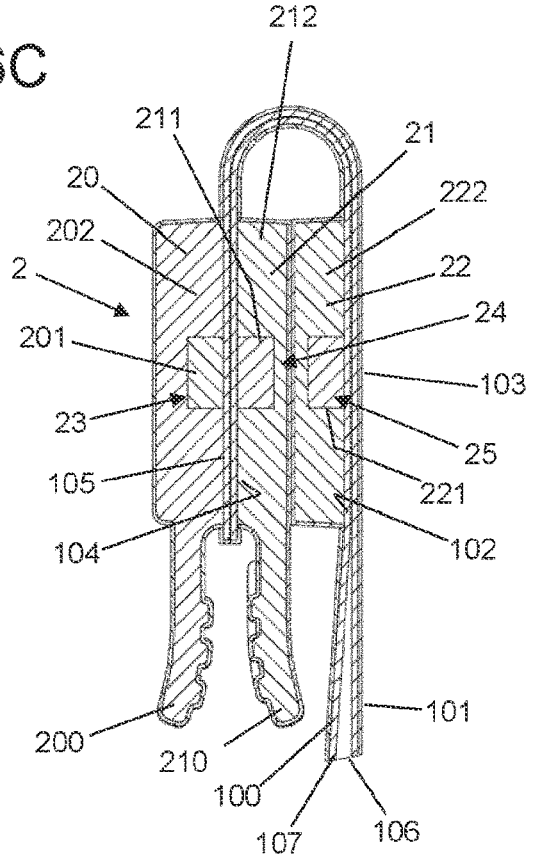
FIG. 6C shows an enlarged view in section C of FIG. 6B.
Figure 7:
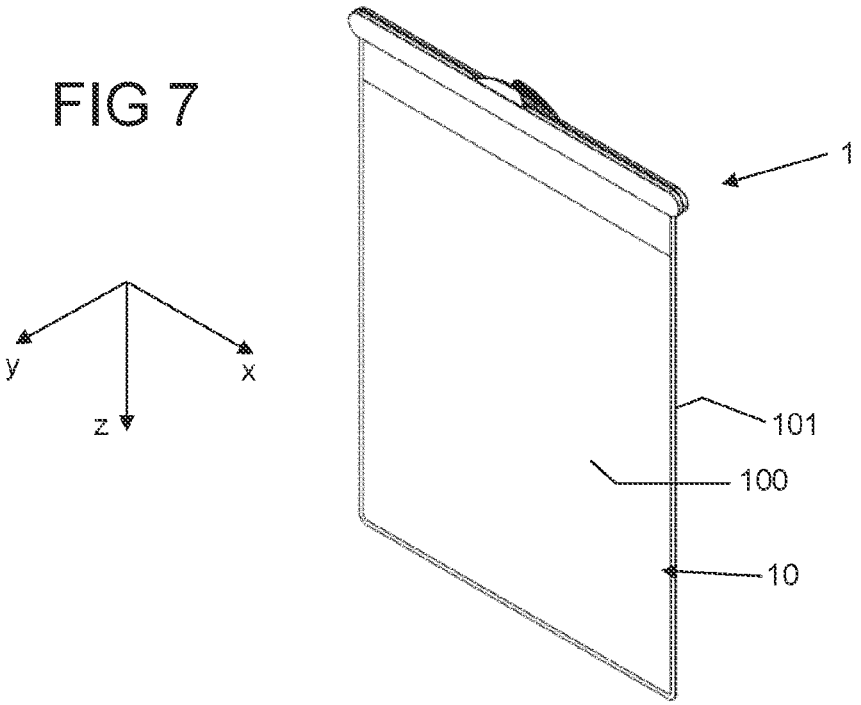
FIG. 7 shows a view of a drinking bladder comprising a hollow body and a closure device according to yet another exemplary embodiment.
Figure 8:
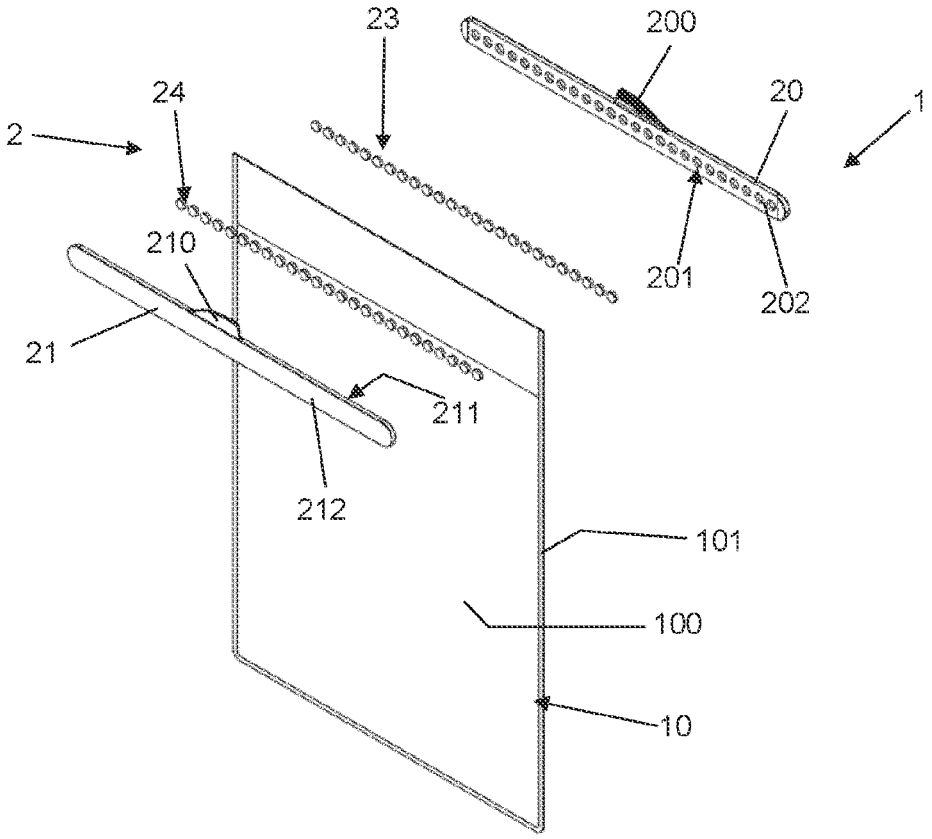
FIG. 8 shows an exploded view of the arrangement of FIG. 7.
Figure 9A:
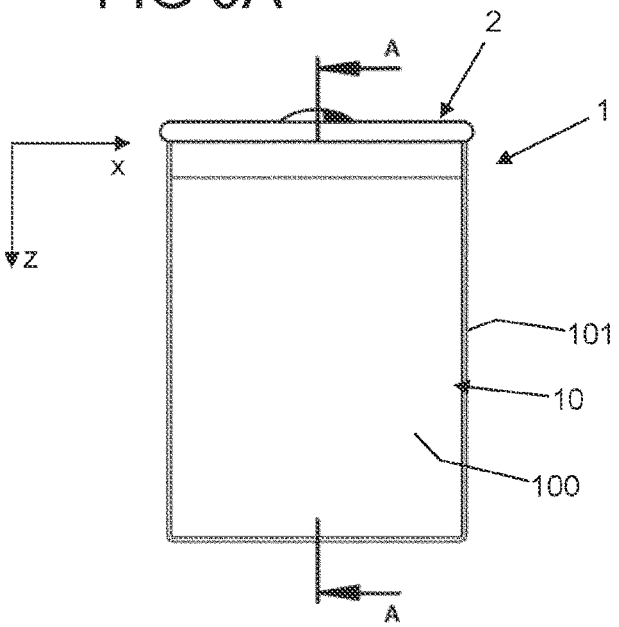
FIG. 9A shows a frontal view of the drinking bladder.
Figure 9B:
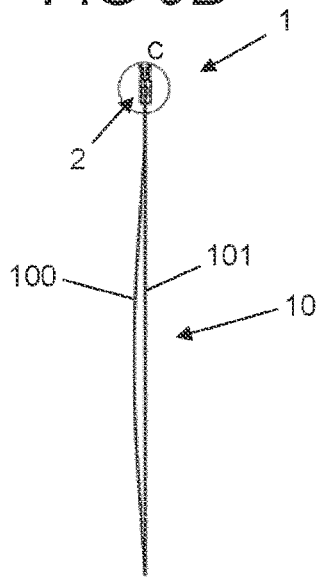
FIG. 9B shows a sectional view along line A-A of FIG. 9A.
Figure 9C:
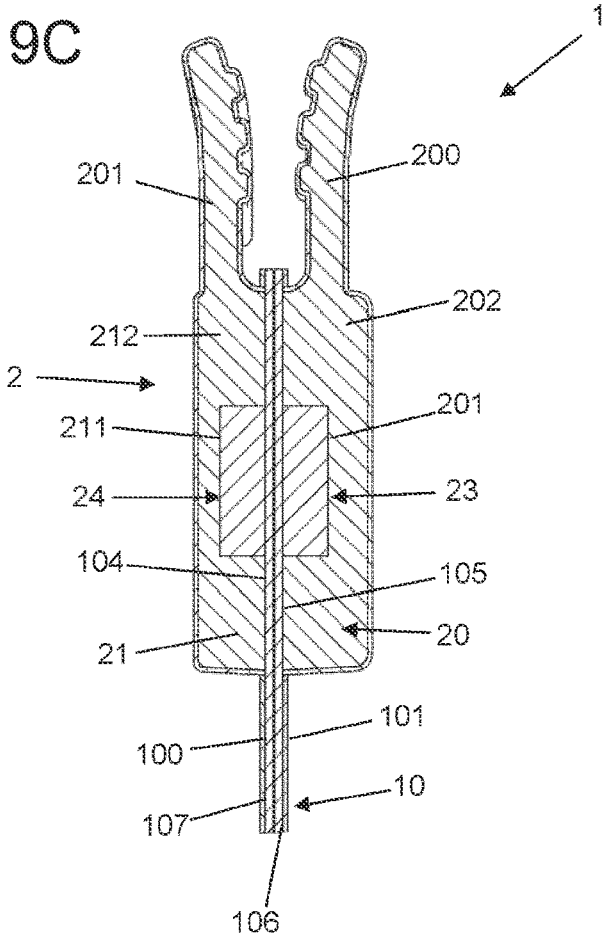
FIG. 9C shows an enlarged view in section B of FIG. 9B.

A third closure part 22 is arranged on a portion 102 of the first wall 100 which is offset from the closing portion 104 of the first wall 100 and, as seen along a path of extension proceeding from the closing portion 104 in a cross-section as shown in FIG. 3C, arranged transversely offset from the first closure part 21.

The closure parts 20, 21, 22 each include a strip body 202, 212, 222 that is longitudinally extended along the transverse direction x and thus extends transversely to the vertical direction z.

The closure parts 20, 21, 22 are designed to cooperate in a magnetically attracting manner. In the illustrated exemplary embodiment, the strip bodies 202, 212, 222 are each formed from a magnetically acting material, for example in that the strip bodies 202, 212, 222 are made of a plastic material or a silicone material into which magnetically active particles are embedded.

The strip bodies 202, 212, 222 can each act as permanent magnets and then face each other in pairs with unlike poles in such a way that in the sequence shown in FIG. 3C the strip bodies 202, 212, 222 magnetically attract each other. Alternatively, for example, merely the strip body 212 of the first closure part 21 can act as a permanent magnet, while the other strip bodies 202, 222 are of the ferromagnetic type so that the associated closure parts 20, 22 act as a magnetic armature. It is also conceivable, for example, that the closure parts 20, 21 are designed to be permanently magnetic at their strip bodies 202, 212, while the strip body 222 of the third closure part 22 acts ferromagnetically.

As can be taken for example from FIG. 3C, the strip bodies 202, 212, 222 are enclosed between the inner layer 106 and the outer layer 107 of the respectively associated wall 100, 101. The strip bodies 212, 222 of the closure parts 21, 22 are enclosed between the inner layer 106 and the outer layer 107 of the first wall 100, while the strip body 202 of the closure part 20 is enclosed between the inner layer 106 and the outer layer 107 of the second wall 101.

The closing portions 104, 105 are urged into flat contact with each other by the first closure part 21 and the second closure part 20 in such a way that the closing portions 104, 105 formed by the inner layers 106 of the walls 100, 101 rest against each other in the manner of membranes and thus sealingly close the hollow body 10. The closure compound 2V formed by the closure parts 20, 21 is held in a defined closed position by the third closure part 22, wherein a 180° convolution of the walls 100, 101 in a region between the closing portions 104, 105 and portions 102, 103 transversely offset from the closing portions 104, 105 is effected, as this can be taken from FIG. 3C. This further improves the tightness of the closure device 2 in the closing position.

The first closure part 21 and the second closure part 20 each include a handle element 200, 210 which can be grasped by a user. By action on the closure parts 20, 21, the closure parts 20, 21 can be released in particular from the further, third closure part 22 and be adjusted into a release position. In this release position, the closure parts 20, 21 can be moved away from each other along an opening direction y, which is perpendicular to the transverse direction x and to the vertical direction z, and hence the closing portions 104, 105 can be separated from each other so that the interior of the hollow body 10 is accessible through the opening cleared thereby.

In an exemplary embodiment shown in FIGS. 4 to 6A-6C, the strip bodies 202, 212, 222 are not entirely made of a magnetic material, but each include an arrangement of receiving openings 201, 211, 221 in which discrete magnetic elements of one magnet arrangement 23, 24, 25 each are received. The discrete magnetic elements are lined up one beside the other along the transverse direction x and thus form a linear array of magnetic elements, wherein in the closed position the magnet arrangements 23, 24, 25 of the different closure parts 20, 21, 22 cooperate in a magnetically attracting manner and thus sealingly close the hollow body 10 via the closing portions 104, 105.

The discrete magnetic elements of the magnet arrangements 23, 24, 25 can each be formed by discrete permanent magnets, for example from a neodymium material. It is also conceivable, however, that merely one magnet arrangement 23, 24, 25 or two of the magnet arrangements 23, 24, 25 include discrete permanent magnets, while the other magnet arrangements 23, 24, 25 are formed of discrete ferromagnetically active elements. Otherwise, the exemplary embodiment of FIGS. 4 to 6A-6C is functionally identical to the exemplary embodiment of FIGS. 1 to 3A-3C, in particular also with regard to the manufacture of parts of the drinking bladder 1 from a material containing an antimicrobially active additive so that in this respect reference fully is made to the preceding explanations.

The exemplary embodiment of FIGS. 7 to 9A-9C corresponds to the exemplary embodiment of FIGS. 4 to 6A-6C, wherein in this case there is no third closure part 22, as in the exemplary embodiment of FIGS. 4 to 6A-6C, and the closure device 2 thus is formed by merely two closure parts 20, 21. Otherwise, the drinking bladder 1 is functionally identical to the drinking bladder 1 of FIGS. 4 to 6A-6C.

FIGS. 10A to 18B show design variants of the proposed solution, in which the closure device 2 is further developed with a securing mechanism S. Via this securing mechanism S, the closing position of the closure compound 2V additionally is mechanically secured. The securing mechanism S in particular is adapted to absorb shear forces (in the xz-plane or in the vertical direction z, −z) and/or lifting forces (in the spatial direction y), which act as a result of an increased internal pressure in the hollow body 10, for example due to a liquid received therein. Under the effect of these shear forces there is otherwise an increased risk for the closure compound 2V to be moved away from the third closure part 22 and to be folded about the spatial axis parallel to the x-direction (upwards) into the release position, and in addition for the two closure parts 20 and 21 to be moved away from each other.

Figure 10B:
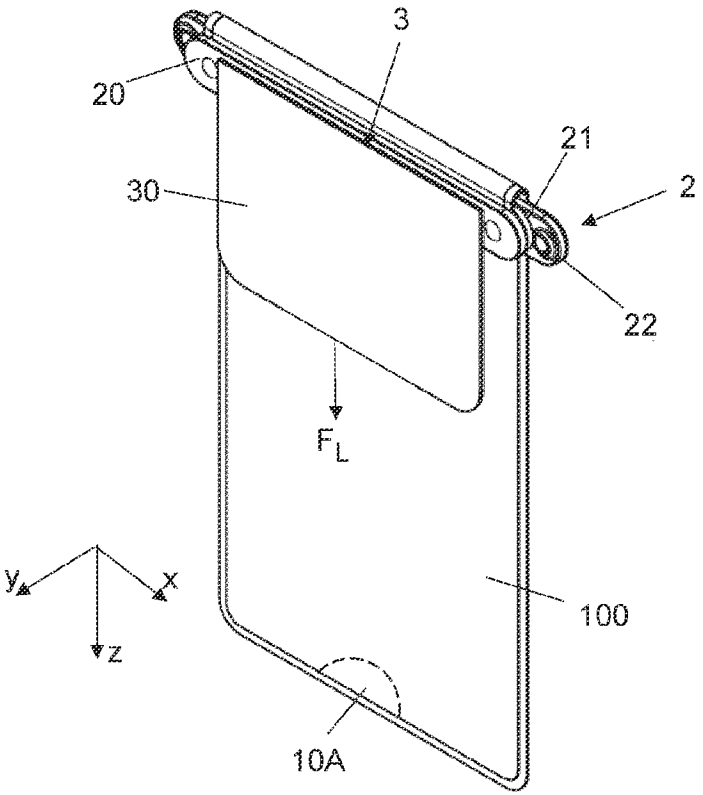
FIGS. 10A-10B show a development of the drinking bladder shown in FIGS. 1 to 9C, on which a proposed securing mechanism additionally is provided, which is shown in two different positions.
Figure 10A:
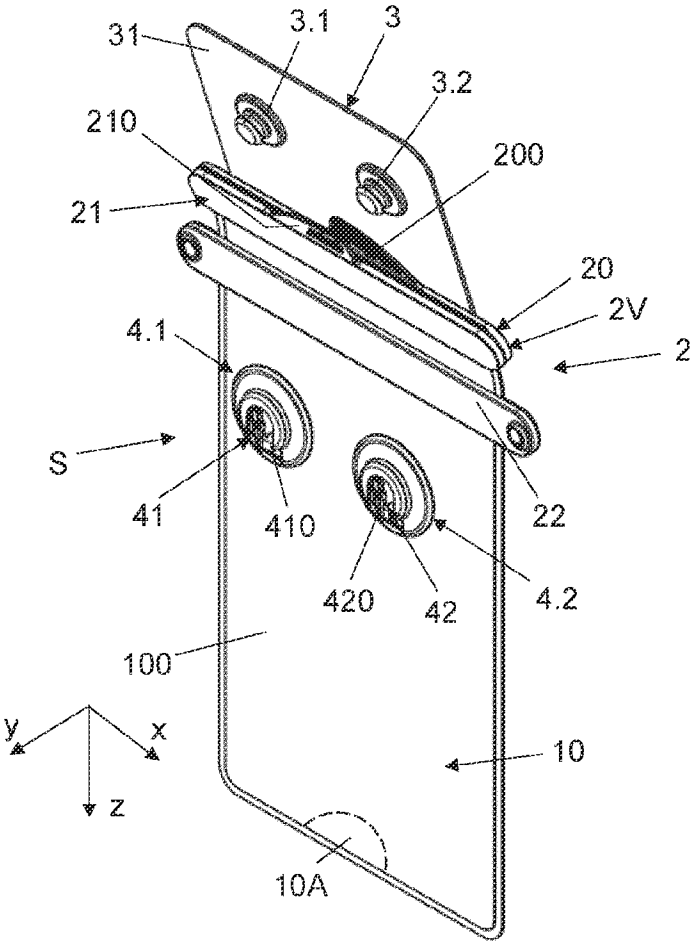

In the design variant of FIGS. 10A and 10B, an additional securing element in the form of a securing tab 3 is arranged on the closure compound 2V. This securing tab 3 is fixed to the second closure part 20 and forms a carrier body for a pair of first securing parts 3.1, 3.2. The first securing parts 3.1 and 3.2 protrude from an inner surface 31 of the securing tab 3 with a securing pin and in the closing position of the closure compound 2V are completely covered by an outer surface 30 of the securing tab 3.

When the closure compound 2V is folded into its closing position corresponding to FIG. 10B, the first securing parts 3.1, 3.2 automatically positively snap into second securing parts 4.1 and 4.2 of the securing mechanism S, which are arranged on the wall 100. On the second securing parts 4.1 and 4.2, which are arranged at a distance to the third closure part 22 in z-direction, engagement openings 41 and 42 are formed, into each of which the securing pins of the first securing parts 3.1 and 3.2 snap into place. In the present case, a magnet arrangement each is provided in a pair of first and second securing parts 3.1/4.1, 3.2/4.2 in such a way that the first securing parts 3.1 or 3.2 each are adjusted into a positive locking position on the respective second securing part 4.1 or 4.2 with magnetic support, when on folding of the closure compound 2V the first securing part 3.1, 3.2 has been approached sufficiently to the associated second securing part 4.1, 4.2 and hence to the securing tab 3. By action of the respective magnet arrangement, the respective first securing part 3.1, 3.2 is displaced into the proper locking position along an insertion gap 410 or 420, which is provided on the engagement opening 41, 42 of its associated second securing part 4.1 or 4.2 and extends radially with respect to the engagement opening 41 or 42. Thus, a pair of securing parts 3.1/4.1, 3.2/4.2 each forms a magnetically supported closure.

When the closure compound 2V is in the proper closing position with respect to the third closure part 22, the securing mechanism S and the interlocking securing parts 3.1/4.1, 3.2/4.2 additionally mechanically secure the closure compound 2V against folding back into the release position. To release the securing mechanism S, a release force $F_L$ must specifically be applied onto the securing tab 3 by a user in order to bring the first and second securing parts 3.1/4.1, 3.2/4.2 out of engagement. The release force $F_L$ must be applied in order to displace the first securing parts 3.1, 3.2, which are fixed to the securing tab 3, along the respective insertion gap 410 or 420 out of an engagement opening 41 and 42 of the associated wall-side second securing part 4.1 and 4.2. In the illustrated exemplary embodiment, the insertion gaps 410 and 420 extend parallel to each other in the z-direction so that the release force $F_L$ must be applied onto the securing tab 3 along the z-direction.

Alternatively, however, another orientation of the insertion gaps 410, 420 is of course also possible. In particular, it is conceivable that the insertion gaps 410, 420 each are open in the transverse direction x and hence the securing tab 3 initially must be displaced transversely, before folding back of the closure compound 2V and hence a removal from the third closure part 22 is possible.

Figure 11B:
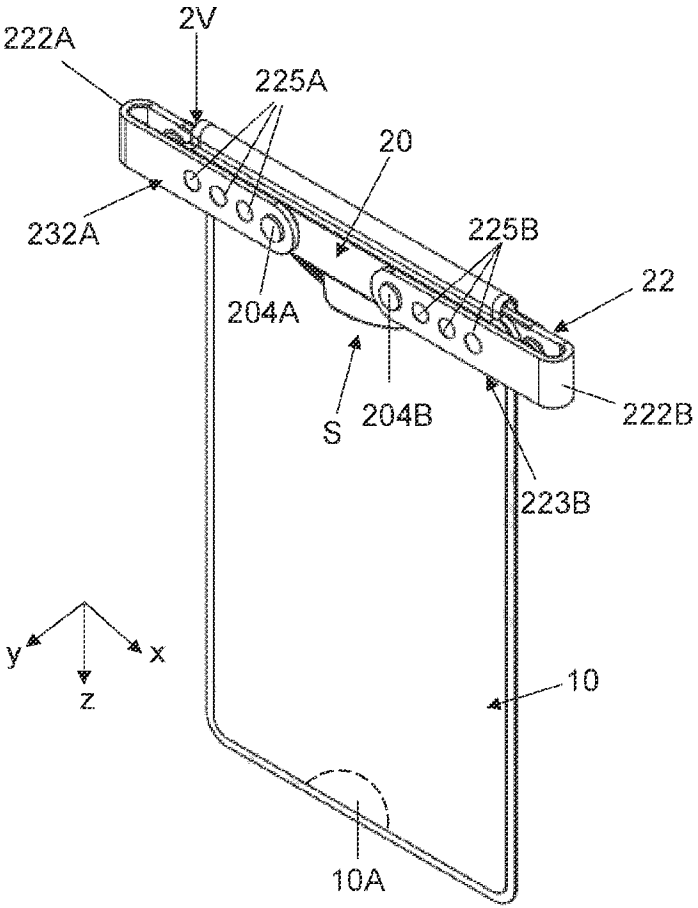
FIGS. 11A-11B show another design variant with an additional securing mechanism that here includes two strip-shaped securing tabs, which in FIG. 11A are folded down and in FIG. 11B are pivoted into a securing position.
Figure 11A:
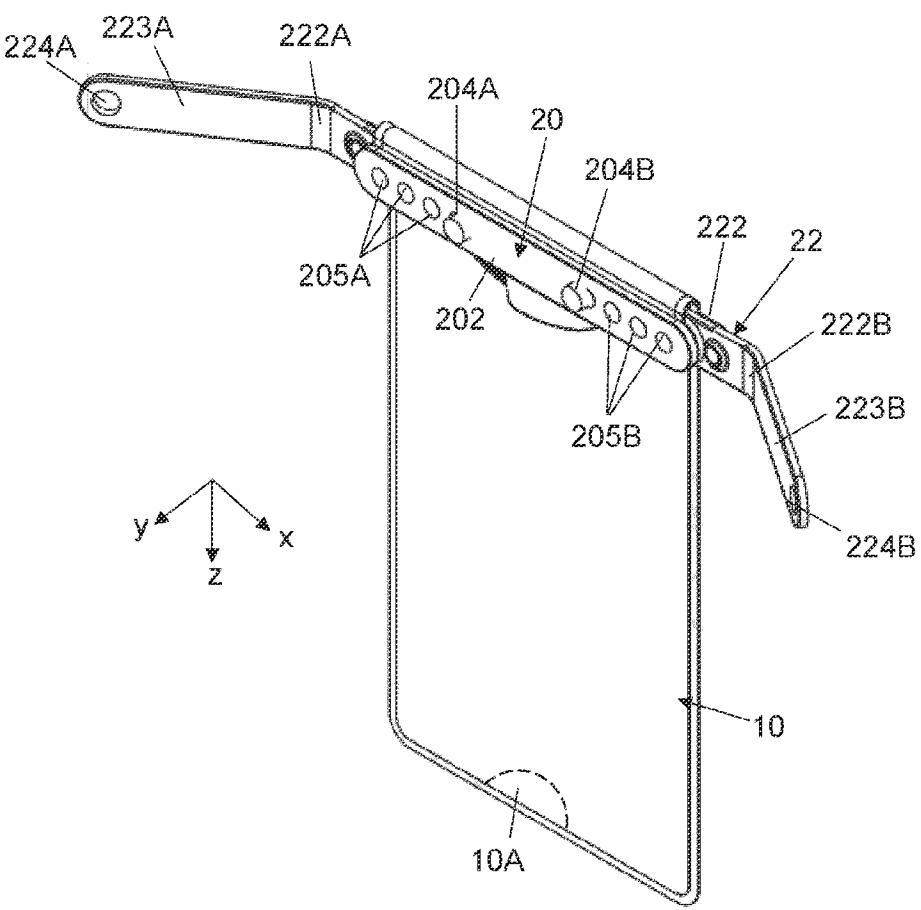

In the design variant of FIGS. 11A and 11B, the securing mechanism S includes two securing parts in the form of narrow, strip-shaped securing tabs 223A, 223B which are provided via one film hinge 222A or 222B each at a respective longitudinal end of the third strip body 222 of the third closure part 22. The securing tabs 223A and 223B thus are each articulated to the strip body 222 of the third closure part 22 via a film hinge 222A or 222B.

In addition, additional securing parts of the securing mechanism S in the form of securing pins 204A and 204B are formed on the second strip body 202 of the second closure part 20. The securing pins 204A and 204B protrude from the strip body 202 in the y-direction, when the closure compound 2V is in its closing position with respect to the third closure part 22. On the securing tabs 223A and 223B, (shear force) receptacles 224A and 224B in the form of through openings are each formed, which by folding the securing tabs 223A and 223B about a joint axis defined with the respective film hinge 222A and 222B and extending parallel to the z-direction can be positively brought in engagement with an associated securing pin 204A or 204B.

The securing pins 204A and 204B each are provided at a distance to a longitudinal end of the strip body 202 so that a securing tab 223A or 223B always encloses at least one end of the strip body 202 when its receptacle 224A or 224B has been brought in engagement with the associated securing pin 204A or 204B. A flat portion of the respective securing tab 223A or 223B thus is disposed directly opposite a portion of the strip body 202.

To support the positive connections between the securing tabs 223A, 223B of the third closure part 22 and the second closure part 20 of the closure compound 2V in the securing position of the securing tabs 223A, 223B defined therewith and illustrated in FIG. 11B, there can be provided a magnet arrangement with magnetic elements 205A, 205B on the closure compound 2V and magnetic elements 225A, 225B on the securing tabs 223A, 223B. The magnetic elements 205A, 205B of the closure compound 2V, which in FIG. 11A by way of example are arranged on the second strip body 202 of the second closure part 20, cooperate with the magnetic elements 225A and 225B of the securing tabs 223A or 223B in a magnetically attracting manner. In this way, the abutment of the folded securing tabs 223A, 223B against the strip body 202 and the engagement of a respective securing pin 204A, 204B on the side of the strip body into a tab-side receptacle 224A or 224B are supported.

Via the securing tabs 223A and 223B of the securing mechanism S in the variant of FIGS. 11A and 11B, which each are unilaterally articulated to the third closure part 22, in particular lifting of the closure compound 2V from the third closure part 22 or of the longitudinal ends of the strip bodies of the closure parts 20, 21, 22 from each other (in the spatial direction y) by action of an increased internal pressure in the hollow body 10, and hence an undesired opening of the closure device 2 in the case of a cavity 10 filled with liquid, is counteracted.

Figure 14:
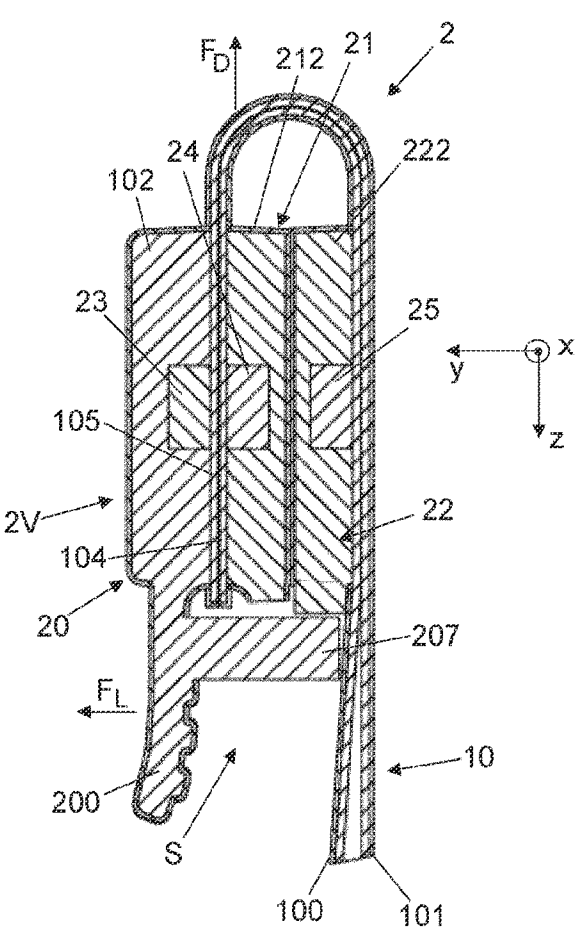
FIG. 14 in a view corresponding with FIG. 12 shows another development in which an additional mechanical securement is provided via a protruding securing web.
Figure 13:
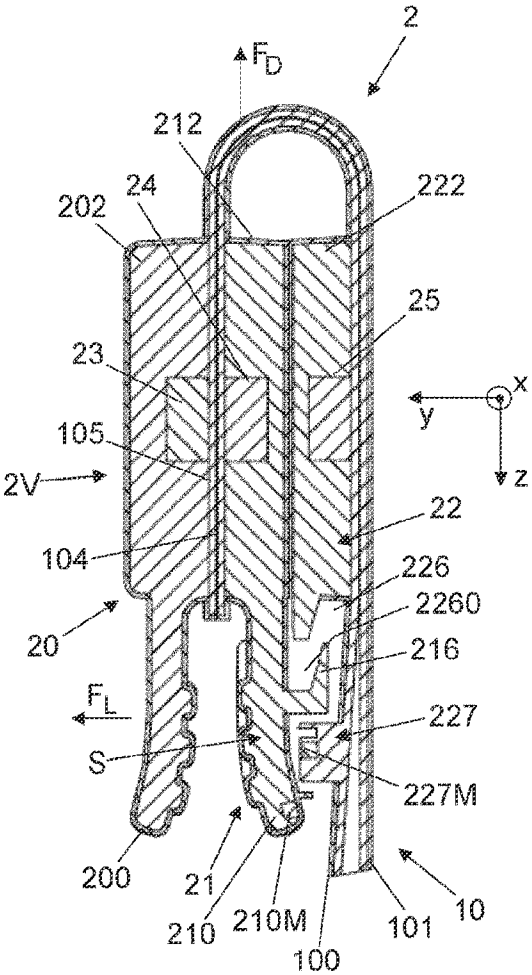
FIG. 13 in a view corresponding with FIG. 12 shows a development in which the reaching of a desired position of a securing part of the securing mechanism is magnetically supported.
Figure 12:
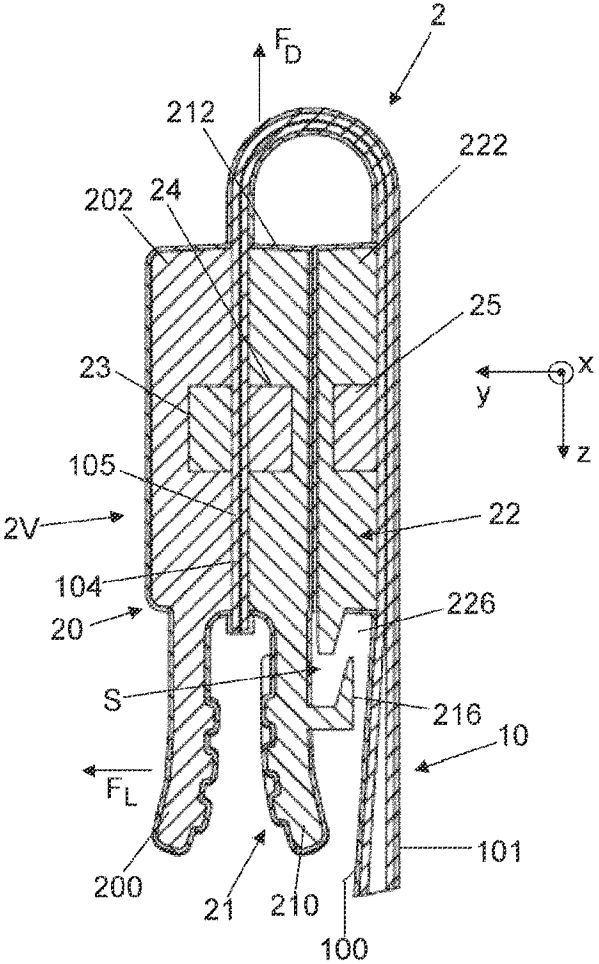
FIG. 12 in a sectional view corresponding with FIG. 3C shows another design variant in which a securing mechanism is provided, which comprises two securing parts engaging one behind the other under a load.

In the design variants of FIGS. 12, 13 and 14, the closure device 2 is each shown in a sectional representation corresponding to FIG. 3C. In each of the design variants shown with FIGS. 12, 13 and 14, the closure device 2 is again conFIG.d with an additional securing mechanism S. This securing mechanism S again counteracts a removal of the closure compound 2V disposed in the closing position from the third closure part 22 and hence in particular a shearing off from the third closure part 22 and possibly a separation of the two closing layers 104 and 105 from each other by a defined form fit—here between the closure compound 2V and the third closure part 22. The securing mechanism S, however, each is conFIG.d in such a way that by pulling the closure compound 2V along the spatial direction y with a release force $F_L$—in any case in an unloaded state of the closure device 2—the closure compound 2V can easily be removed from the third closure part 22 by a user and can be folded back into the release position (upwards), when for example liquid is to be refilled into the hollow body 10 via the opening between the closing portions 104 and 105.

In the design variant of FIG. 12, the securing mechanism S includes a first securing part in the form of a securing hook 216 on the first closure part 21. In the closing position of the closure compound 2V, the securing hook 216 protrudes from the first closure part 21 in the direction −y towards the (first) wall 100. For example, the securing hook 216 therefor is formed on the handle element 210.

In the closing position of the closure compound 2V, the securing hook 216 is disposed opposite a securing cutout 226 of a second securing part of the securing mechanism S, which is formed by the third closure part 22. The securing cutout 226 is open in the z-direction so that the securing hook 216 protruding from the first closure part 21 in the −y-direction can positively engage into the securing cutout 226 with a hook end protruding in the −z-direction and hence can locally engage behind the third closure part 22.

In the closing position of the closure compound 2V, the securing hook 216 initially is in an intermediate position in which the securing hook 216 does not (yet) engage into the securing cutout 226 with its hook end. In the intermediate position, however, the securing hook 216 is disposed opposite the securing cutout 226 in such a way that under a load acting on the closure device 2 due to an increased internal pressure in the hollow body 10 and a resultant pressure or shear force component $F_D$ on the closure compound 2V, which acts in the direction −z, the securing hook 216 is brought into positive engagement with the securing cutout 226. Thus, by action of the increased internal pressure the securing hook 216 is displaced into an engagement position in which the securing hook 216 engages behind a portion of a second securing part formed by the third closure part 22 and in this way blocks the closure compound 2V against removal from the third closure part 22. Hence, the closure compound 2V is also blocked against folding (in FIG. 12 in clockwise direction) about the spatial axis parallel to the spatial direction −x into the release position.

In the development of FIG. 13, a positioning portion 227 protruding in the y-direction is provided on the wall 100 opposite the safety cutout 226. This wall-side positioning portion 227 carries a magnetic element 227M which cooperates with a magnetic element 210M of the first closure part 21 in a magnetically attracting manner. The magnetic element 210M on the side of the closure part here by way of example is integrated in the handle element 210. Via the force of magnetic attraction between the magnetic elements 210M and 227M, the proper positioning of the securing hook 216 with respect to the securing cutout 226 can be ensured by folding the closure compound 2V into its closing position. In particular, it can thereby be ensured that upon folding of the closure compound 2V into its closing position, the securing hook 216 engages into an engagement opening 2260 formed between the securing cutout 226 and the positioning pin 227, as desired, and is properly disposed opposite the securing cutout 226 in such a way that a positive, blocking engagement of the securing hook 216 into the securing cutout 226 is possible.

The magnetic elements 227M and 210M can also be used to support the securing hook 216 in taking the engagement position. The magnetic elements 227M and 210M can cooperate in such a way that the securing hook 216 is automatically displaced from the intermediate position shown in FIG. 13 into the engagement position or at least a corresponding adjustment into the engagement position is supported. Thus, when the securing hook 216 properly engages into the engagement opening 2260 with the closure compound 2V being folded into the closing position, the securing hook 216 is driven further into the engagement position by action of the magnetic elements 227M and 210M. In the engagement position, the securing hook 216 then engages behind the third closure part 22. In the securing position defined thereby, a positive blocking engagement between closure compound and third closure part 22 thus is given already, which in the securing position of the design variant of FIG. 12 is accomplished only by loading the closure device 2.

In the design variant of FIG. 14, a securing part in the form of a securing web 207 is provided on the closure compound 2V as part of the securing mechanism S. This securing web 207 is formed on the second closure part 20 and, in the closing position of the closure compound 2V, protrudes from the second closure part 20 in the direction of the first wall 100 and hence in the direction −y. The securing web 207 protrudes to such an extent that an end of the securing web 207 engages below or behind the third closure part 22—as seen in the z-direction. Thus, in the −z-direction the securing web 207 and hence the closure compound 2V disposed in its closing position cannot be displaced past the third closure part 22. A adjustment of the closure compound 2V in the −z-direction thus is mechanically blocked by the cooperation of the securing web 207 with the third closure part 22. A shear-force-related removal of the closure compound 2V from the third closure part 22, for example due to an increased internal pressure in the cavity 10, consequently also is prevented thereby. The securing web 207 first must be adjusted away from the wall 10 and hence also away from the third closure part 22 by a targeted displacement of the closure compound 2V in the y-direction so that the securing web 207 no longer blocks folding of the closure compound 2V.

Figure 15A:
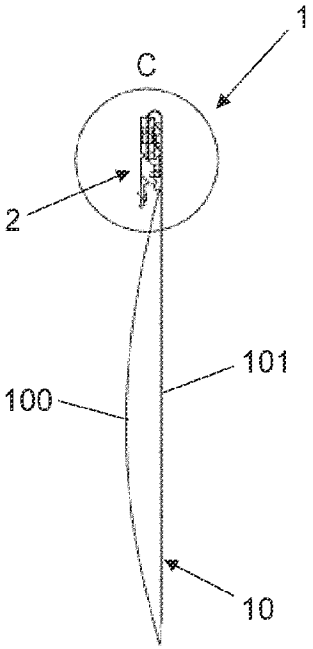
FIG. 15A shows a sectional view corresponding to the sectional line A-A of FIG. 15.
Figure 15:
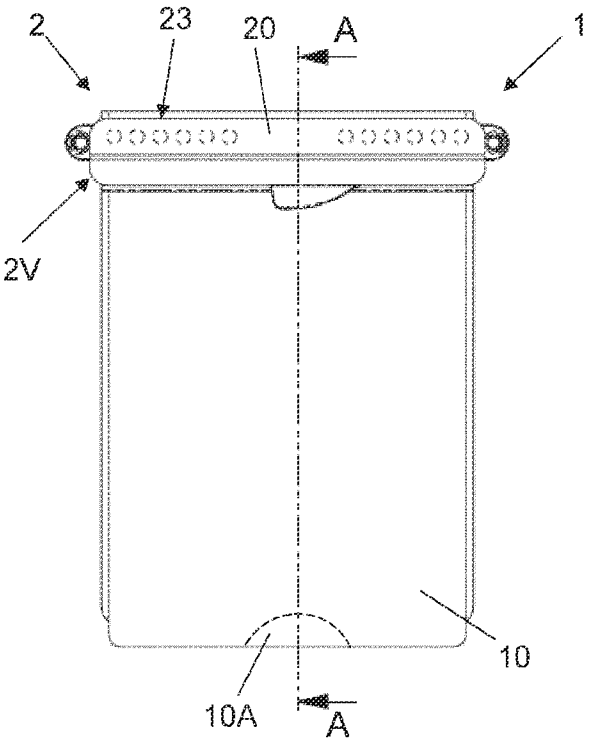
FIG. 15 shows a front view of another design variant of a proposed drinking bladder with another design variant of a proposed closure device.

FIG. 15 shows a front view of another design variant of a proposed drinking bladder 1 with an outlet 10A for the connection of a drinking tube to the hollow body 10. FIG. 15A shows the drinking bladder 1 of FIG. 15 in a sectional view. FIGS. 16A-16C, 17A-17B and 18A-18B show further variants of the closure device 2 in an enlarged view corresponding to section C of FIG. 15A.

Figure 16C:
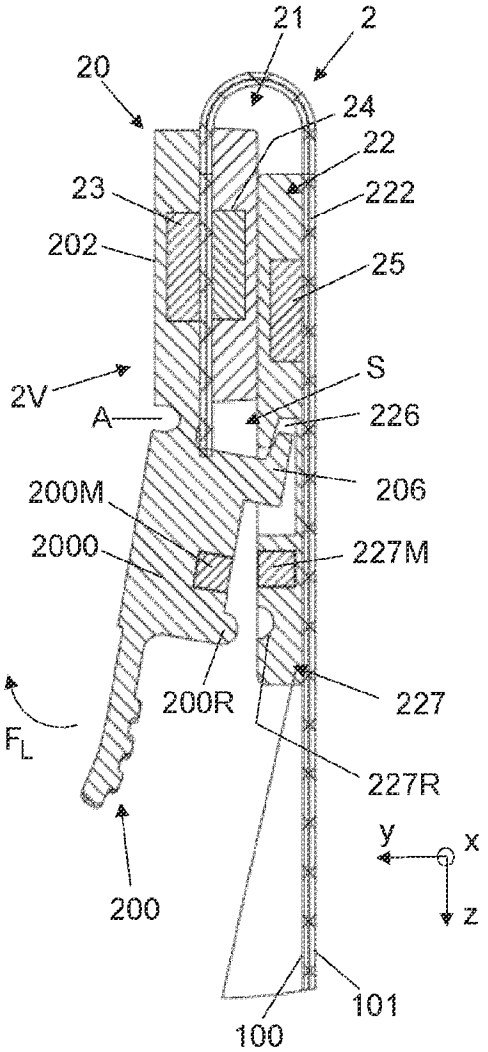
FIGS. 16A-16C each in an enlarged view of section C of FIG. 15A show a development of the closure device in different phases on closing and opening, in which a securing part of the closure compound is displaced into an engagement position under magnetic force control, when the closure compound takes a closing position and the engagement position is defined by an additional form-fit element on the side of the closure compound.
Figure 16B:
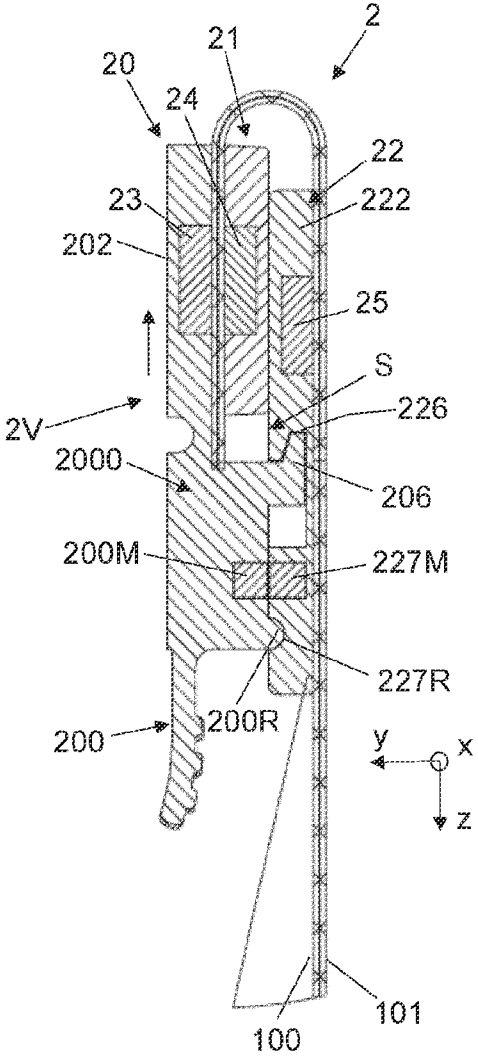
Figure 16A:
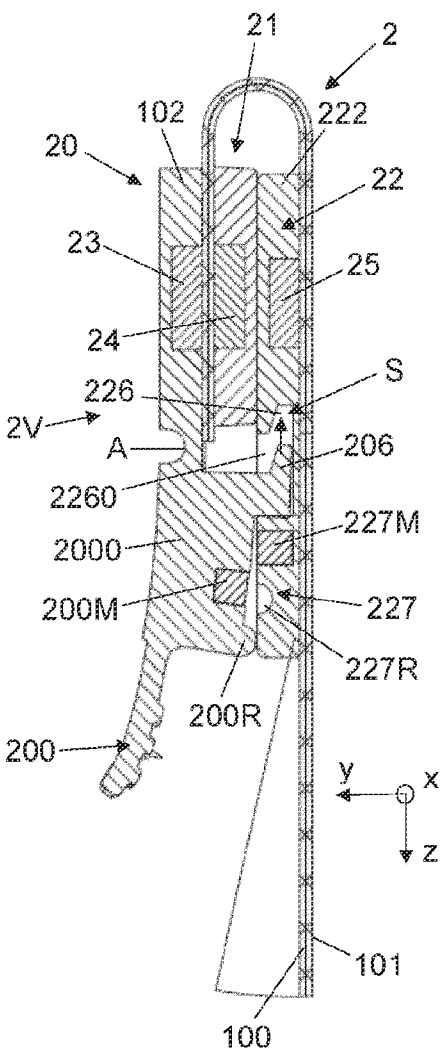

In the variant of FIGS. 16A-16C, analogous to the exemplary embodiment of FIG. 13, the closure compound 2V is formed with an additional securing component in the form of a securing hook 206 which in the closing position of the closure compound 2V can positively engage into a securing cutout 226 on the third closure part 22 in order to additionally mechanically secure the closing position of the closure compound 2V. In contrast to the exemplary embodiment of FIG. 13, the securing hook 206 is not formed on the first closure part 21, but on the second closure part 20, here by way of example on a handle body 2000 of the handle element 200. Hence, the securing hook 206 in the design variant of FIGS. 16A to 16C is formed to protrude from that second closure part in the direction of the wall 100 which in the closing position of the closure compound 2V is located before the first and third closure parts 21, 22 as seen along the direction −y (opposite to the opening direction y).

On the wall 100 an engagement opening 2260 for the securing hook 206 on the side of the closure compound again is defined between the strip body 222 of the third closure part 22 and a positioning portion 227 spaced apart therefrom in the vertical direction z. To facilitate the introduction of the securing hook 206 into the engagement opening 2260, the handle body 2000 is articulated to the strip body 202 of the second closure part 20. For this purpose, a wall thickness in a transition portion A between the strip body 202 and the handle body 2000 adjoining thereto in the vertical direction z is reduced specifically and is visible as an indentation in the cross-section of FIGS. 16A to 16C. In this way, a specific elasticity is incorporated at the transition portion A between the strip body 202 and the handle body 2000 in order for a user to be able to displace the handle body 2000 relative to the strip body 202 about a joint axis extending parallel to the transverse direction x. Thus, the handle body 200 can be connected to the strip body 202 in particular via a film hinge defined with the transition portion A.

With the transfer of the closure compound 2V into its closing position corresponding to FIG. 16A, the securing hook 206 is introduced into the engagement opening 2260 and initially is disposed in an intermediate position corresponding to FIG. 16A. Via magnetic elements 227M and 200M of the positioning portion 227M and of the handle body 2000, which have an attracting effect on each other, the closure compound 2V with the securing hook 206 then is displaced along the vertical direction −z (upwards in FIGS. 16A to 16C). This results in a displacement of the securing hook 206 from the intermediate position into an engagement position in which the securing hook 206 positively engages into the securing cutout 226 on the third closure part 22.

To specify and possibly additionally secure the engagement position between the securing hook 206 on the side of the closure compound and the third closure part 22, there is provided a positive connection between the handle body 2000 and the positioning portion 27. A form-fit element in the form of a latching nose 200R is formed on the handle body 2000 at a distance to the securing hook 206. This latching nose 200R positively snaps into a latching opening 227R on the positioning portion 227 when the closure compound 2V with the securing hook 206 is displaced from the intermediate position into the engagement position (cf. FIG. 16B).

To release the securing mechanism S and hence again bring the securing hook 206 out of engagement with the third closure part 22, it is sufficient for a user to grasp the handle element 200 and pivot the handle body 2000 about the joint axis defined with the transition portion A towards the outside, i.e. away from the wall 100. The position of the joint axis defined with the transition portion A and the securing cutout 226 as well as the securing hook 206 are adjusted to each other such that due to the corresponding pivotal movement the securing hook 206 is displaced out of the securing cutout 226 and the engagement opening 2260. Hence, it is easily possible for a user to open the closure device 2, although in the closing position the closure compound 2V is secured against inadvertent opening in several respects and in particular counteracts shear forces acting in the xz-plane and in the vertical direction −z, which result from an increased internal pressure in the hollow body 10.

Figure 17B:
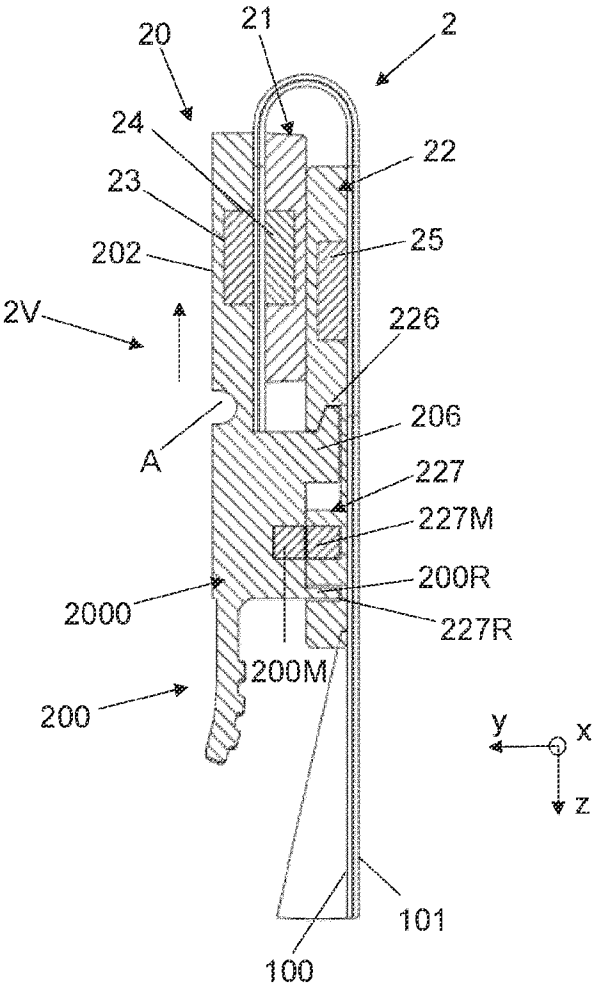
FIGS. 17A-17B in views corresponding with FIGS. 16A-16C show another design variant in different phases on closing of the closure device.
Figure 17A:
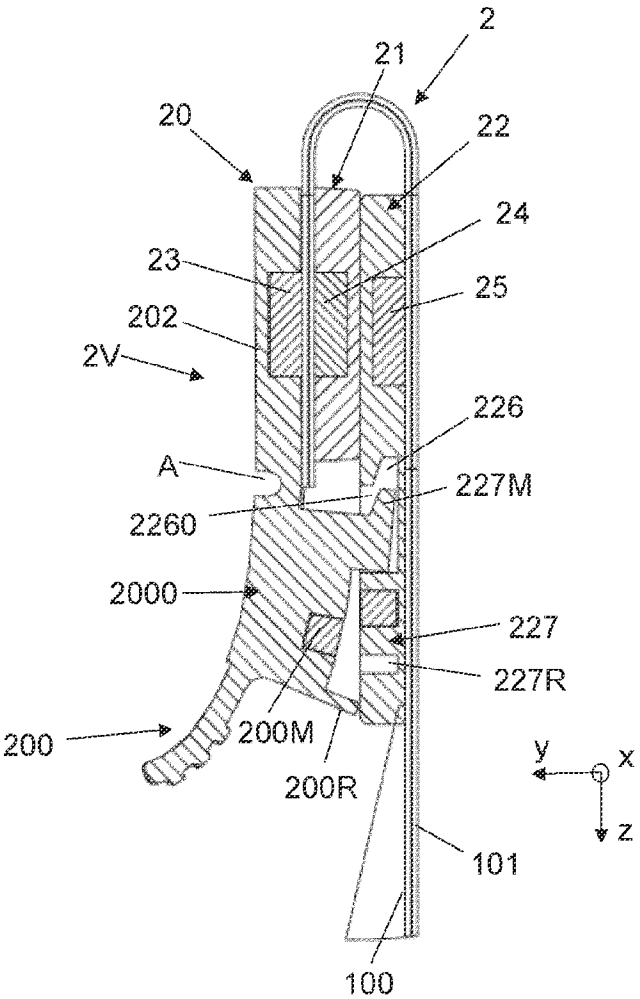

The design variant of FIGS. 17A and 17B in principle is comparable with the design variant of FIGS. 16A to 16C. In contrast to the design variant of FIGS. 16A to 16C, merely the form fit in the engagement position between the handle body 2000 and the positioning portion 227 is designed differently in the design variant of FIGS. 17A and 17B. Instead of a latching nose, a latching web 200R protruding like a pin in cross-section is provided on the handle body 2000, which can engage into a correspondingly formed and e.g. slit-shaped latching opening 227R on the positioning portion 227R.

Figure 18B:
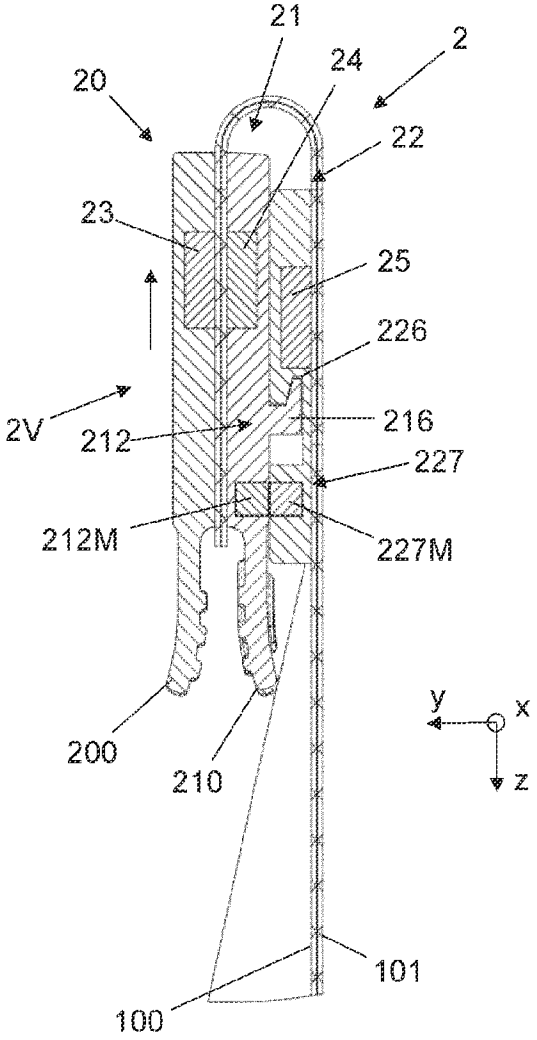
FIGS. 18A-18B in views corresponding with FIGS. 17A and 17B show another design variant in which a securing part on the side of the closure compound is provided on the first closure part.
Figure 18A:
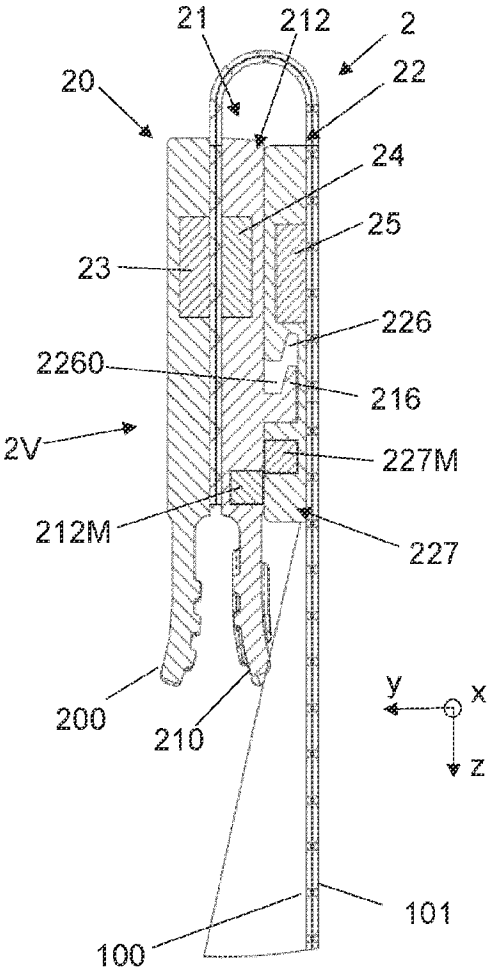

In the design variant of FIGS. 18A and 18B, analogously to the design variants of FIGS. 16A-16C and 17A-17B, a securing mechanism S is provided, in which the closure compound 2V with a securing part in the form of a securing hook 216 is displaced from an initially taken intermediate position into an engagement position controlled by magnetic force, in which engagement position the securing hook 216 positively engages into a securing cutout 226 on the third closure part 22. In the design variant of FIGS. 18A-18B, the securing hook 216 is formed on the first strip body 212 of the first closure part 21. The strip body 212 then also magnetically cooperates with the positioning portion 227 in order to control the automatic displacement of the closure compound 2V into the engagement position. In the design variant of FIGS. 18A-18B, by way of example, at least one additional magnetic element 212M therefor is provided in the strip body 212 in the vertical direction −z at a distance to the magnet arrangement 24. This at least one additional magnetic element 212M of the first closure part 21 by way of example cooperates with at least one magnetic element 227M of the positioning portion 27 in order to displace the closure compound 2V folded in the direction of the wall 100 from the initially taken intermediate position in the vertical direction −z (upwards) into the engagement position.

In an alternative design variant it is of course also possible that the closure compound 2V is repeatedly folded or rolled about an axis parallel to the transverse direction x in order to take the closing position on the wall 100. Furthermore, for securing the closing position by means of the securing mechanism S, it is not absolutely necessary either that a third closure part 22 cooperates with the closure compound 2V in a magnetically attracting manner. Consequently, in the design variants of FIGS. 10A to 18B, in particular a magnet arrangement 25 can be omitted in the strip body 222 of the third closure part 22 without this impairing the functions of the securing mechanism S.

The idea underlying the proposed solution is not limited to the exemplary embodiments described above, but can also be realized in an entirely different way.

LIST OF REFERENCE NUMERALS

1 drinking bladder (liquid reservoir)
10 hollow body
10A outlet
100, 101 wall
102, 103 portion
104, 105 closing portion
106 inner layer
107 outer layer
2 closure device
2V closure compound
20, 21, 22 closure part
200, 210 handle element
200M magnetic element
200R latching nose/latching web (form-fit element)
2000 handle body
201, 211, 221 receiving openings
202, 212, 222 strip body
204A, 204B securing pin (securing part)
205A, 205B magnetic element
206 securing hook (securing part)
207 securing web (securing part)
210M magnetic element
212M magnetic element
216 securing hook (securing part)
222A, 222B film hinge
223A, 223B securing tab (securing part)
224A, 224B receptacle
225A, 225B magnetic element
226 securing cutout
2260 engagement opening
227 positioning portion
227M magnetic element
227R latching opening
23, 24, 25 magnet arrangement
3 securing tab (securing element)
3.1, 3.2 first securing part
30 outer surface
31 inner surface
4.1, 4.2 second securing part
41, 42 engagement opening
410, 420 insertion gap
A transition portion
$F_D$ pressure/shear force component
$F_L$ release force
S securing mechanism
x, y, z direction

The invention claimed is:

1. A drinking bladder, comprising a hollow body for receiving a liquid, wherein the hollow body has at least one flexible wall and at least one port for connection to a drinking tube, the liquid can be filled into the hollow body via an opening that is formed between a first closing portion and a second closing portion and can be closed by a closure device of the drinking bladder, the closure device includes a first closure part on the first closing portion and a second closure part on the second closing portion, the first closure part has a first strip body longitudinally extended along a transverse direction, the second closure part has a second strip body longitudinally extended along the transverse direction, the first closure part and the second closure part cooperate in a magnetically attracting manner in such a way that in a closed position of the closure device the first closing portion and the second closing portion rest against each other and form a closure compound with the first and second closure parts, the closure compound can be adjusted from a release position, in which the first and second closing portions can be properly separated from each other against a magnetic force applied by the first and second closure parts to clear the opening, by folding the first and the second closing portions at least once into a closing position or rolling the first and second closing portions into the closing position, and the closure compound disposed in its closing position is secured via a securing mechanism, wherein the closure device comprises at least one magnetic element by action of which at least one securing part of the securing mechanism is positioned in a securing position in which the at least one securing part blocks the closure compound against an adjustment into the release position via a form fit.

2. The drinking bladder according to claim 1, wherein via the securing mechanism the closure compound disposed in its closing position is secured against a removal of the closure compound from the closing position due to an increased internal pressure in the hollow body.

3. The drinking bladder, according to claim 2, wherein the first strip body and the second strip body have two longitudinal ends and, in the closed position, the securing mechanism is configured to counteract a lifting force acting on the first strip body and the second strip body at the longitudinal ends and resulting from the increased internal pressure, by action of which mutually opposite longitudinal ends of the first and second strip bodies strive to move away from each other, and/or counteract a shear force resulting from the increased internal pressure, which acts in a middle area of the first strip body and the second strip body at the closure device in a plane extending parallel to the first and second closing portions.

4. The drinking bladder according to claim 1, wherein via the securing mechanism a connection between the closure compound and the wall connected to the first or second closing portion is provided when the closure compound is disposed in the closing position.

5. The drinking bladder according to claim 4, wherein an additional securing element is provided on the closure compound, to which at least one securing part of the securing mechanism is fixed at a distance to the first and second closure parts, and wherein the securing part provided on the securing element forms a first securing part, which in the closing position of the closure compound is positively connected to a second securing part that is provided on the wall.

6. The drinking bladder according to claim 1, wherein the closure device comprises a third closure part on the wall, and in closing position the closure compound and the third closure part cooperate in a magnetically attracting manner in order to hold the closure compound in the closing position.

7. The drinking bladder according to claim 6, wherein via the securing mechanism an additional connection between the closure compound, in particular the first or second closure part, and the third closure part is provided when the closure compound is disposed in the closing position.

8. The drinking bladder according to claim 1, wherein the securing mechanism includes at least one securing part which secures the closure compound in the closing position via a form fit.

9. The drinking bladder according to claim 8, wherein the securing mechanism includes at least two securing parts which in the closing position of the closure compound positively cooperate with each other in order to secure the closure compound in the closing position.

10. The drinking bladder according to claim 1, wherein on transfer of the closure compound into its closing position the at least one securing part is also adjusted into the securing position by action of the at least one magnetic element.

11. The drinking bladder according to claim 1, wherein the at least one securing part can be adjusted into the securing position only after transfer of the closure compound into its closing position.

12. The drinking bladder according to claim 1, wherein an additional securing element is provided on the closure compound, to which at least one securing part of the securing mechanism is fixed at a distance to the first and second closure parts.

13. The drinking bladder according to claim 1, wherein after transfer of the closure compound into its closing position at least one securing part of the securing mechanism can be adjusted into a securing position by pivoting about at least one joint axis, in which securing position the at least one securing part secures the closure compound disposed in its closing position.

14. The drinking bladder according to claim 13, wherein the closure compound can be transferred from the release position into the closing position by folding at least once about a pivot axis parallel to a first spatial direction or rolling the closure compound about a pivot axis parallel to the first spatial direction, a magnetic force for holding the closure compound in its closing position with respect to a third closure part acts along a spatial axis that is parallel to a second spatial direction extending perpendicularly to the first spatial direction, and via the securing mechanism the closure compound is secured against removal from the third closure part by action of a shear force which points in a third spatial direction that is both perpendicular to the first spatial direction and perpendicular to the second spatial direction the joint axis extends parallel to the third spatial direction.

15. The drinking bladder according to claim 14, wherein the securing mechanism includes at least one securing part which is disposed in an intermediate position when the closure compound reaches the closing position, and the securing part can be displaced from the intermediate position into an engagement position in which the securing part blocks the closure compound against an adjustment along the third spatial direction.

16. The drinking bladder according to claim 15, wherein in the engagement position the at least one securing part blocks the closure compound against an adjustment along the third spatial direction and against an adjustment along the second spatial direction.

17. The drinking bladder according to claim 16, wherein the closure device comprises at least one magnetic element by action of which the at least one securing part of the securing mechanism is automatically positioned in the intermediate position when the closure compound is transferred into its closing position.

18. The drinking bladder according to claim 15, wherein the closure device comprises at least one magnetic element with the participation of which the at least one securing part is adjusted from the intermediate position into the engagement position.

19. The drinking bladder according to claim 1, wherein the closure compound can be transferred from the release position into the closing position by folding at least once about a pivot axis parallel to a first spatial direction or rolling the closure compound about a pivot axis parallel to the first spatial direction, a magnetic force for holding the closure compound in its closing position with respect to a third closure part acts along a spatial axis that is parallel to a second spatial direction extending perpendicularly to the first spatial direction, and via the securing mechanism the closure compound is secured against removal from the third closure part by action of a shear force which points in a third spatial direction that is both perpendicular to the first spatial direction and perpendicular to the second spatial direction.

20. A drinking bladder, comprising a hollow body for receiving a liquid, wherein the hollow body has at least one flexible wall and at least one port for connection to a drinking tube, the liquid can be filled into the hollow body via an opening that is formed between a first closing portion and a second closing portion and can be closed by a closure device of the drinking bladder, the closure device includes a first closure part on the first closing portion and a second closure part on the second closing portion, the first closure part has a first strip body longitudinally extended along a transverse direction, the second closure part has a second strip body longitudinally extended along the transverse direction, the first closure part and the second closure part cooperate in a magnetically attracting manner in such a way that in a closed position of the closure device the first closing portion and the second closing portion rest against each other and form a closure compound with the first closure part and the second closure part, the closure compound can be adjusted from a release position, in which the first closing portion and the second closing portion can be properly separated from each other against a magnetic force applied by the first closure part and the second closure part to clear the opening, by folding the first closing portion and the second closing portion at least once about a pivot axis parallel to a first spatial direction into a closing position or rolling the first closing portion and the second closing portion about a pivot axis parallel to a first spatial direction into the closing position, and the closure compound disposed in its closing position is secured via a securing mechanism, wherein after transfer of the closure compound into its closing position at least one securing part of the securing mechanism can be adjusted into a securing position by pivoting about at least one joint axis, in the securing position the at least one securing part secures the closure compound disposed in its closing position, wherein a magnetic force for holding the closure compound in its closing position with respect to a third closure part acts along a spatial axis that is parallel to a second spatial direction extending perpendicularly to the first spatial direction, wherein, via the securing mechanism, the closure compound is secured against removal from the third closure part by action of a shear force which points in a third spatial direction that is both perpendicular to the first spatial direction and perpendicular to the second spatial direction, and wherein the joint axis extends parallel to the third spatial direction.

* * * * *